US007865119B2

(12) United States Patent
Matsuyama et al.

(10) Patent No.: US 7,865,119 B2
(45) Date of Patent: Jan. 4, 2011

(54) COLOR REGISTRATION METHOD AND IMAGE FORMING APPARATUS

(75) Inventors: Kengo Matsuyama, Chiba (JP); Yoshikazu Harada, Nara (JP); Norio Tomita, Nara (JP); Yoshiteru Kikuchi, Yamatokoriyama (JP); Hirokazu Fujita, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 532 days.

(21) Appl. No.: 11/787,147

(22) Filed: Apr. 12, 2007

(65) Prior Publication Data

US 2007/0242986 A1 Oct. 18, 2007

(30) Foreign Application Priority Data

Apr. 14, 2006 (JP) ..... 2006-112604
Jul. 21, 2006 (JP) ..... 2006-199733

(51) Int. Cl.
*G03G 15/01* (2006.01)

(52) U.S. Cl. ..... 399/301

(58) Field of Classification Search ..... 399/72, 399/116, 167, 190, 289, 301
See application file for complete search history.

(56) References Cited

U.S. PATENT DOCUMENTS 6,938,351 B2 * 9/2005 Kobayashi et al. ..... 33/299
2001/0000968 A1 * 5/2001 Hata ..... 347/116
2003/0021613 A1 * 1/2003 Koide ..... 399/167

FOREIGN PATENT DOCUMENTS

JP 07-261499 * 10/1995
JP 2002-108044 4/2002
JP 2002-357942 * 12/2002
JP 2003-177588 6/2003
JP 2004-069801 * 3/2004
JP 2004-294471 10/2004
JP 2005-345668 12/2005

* cited by examiner

*Primary Examiner*—David M Gray
*Assistant Examiner*—Barnabas T Fekete
(74) *Attorney, Agent, or Firm*—Edwards Angell Palmer & Dodge LLP; David G. Conlin; William J. Daley, Jr.

(57) ABSTRACT

A color registration method in a color image forming apparatus including a plurality of drum-type photoconductors for driving some or all of the photoconductors having the same diameter to match pitch fluctuations which correspond to a rotational cycle of the photoconductors, the method including: a first measurement step for forming a first registration image for each color and measuring formation positions of a plurality of predetermined portions in each registration image; a second measurement step for forming a second registration image for each color and measuring formation positions of a plurality of predetermined portions in each registration image; a calculation step for calculating a periodic fluctuation component being contained in the images in different colors and corresponding to the rotational cycle of the photoconductors so as to obtain phases thereof; and a step for adjusting a rotational phase of the photoconductors in order for the obtained phases matching to each other, wherein the interval between first and second registration images in the rotating direction is set such that disturbance components in which a cycle is assumed beforehand, cancel with each other by calculating the deviation.

20 Claims, 23 Drawing Sheets

Even if two colors are shifted from the reference position and they are shifted in the same manner, the misregistration is unnoticeable.

When drive motor is pulse motor, drive signal is pulse signal having fixed frequency.
Modulation signal is signal having frequency that is inverse number of rotational cycle (T) of photoconductor.

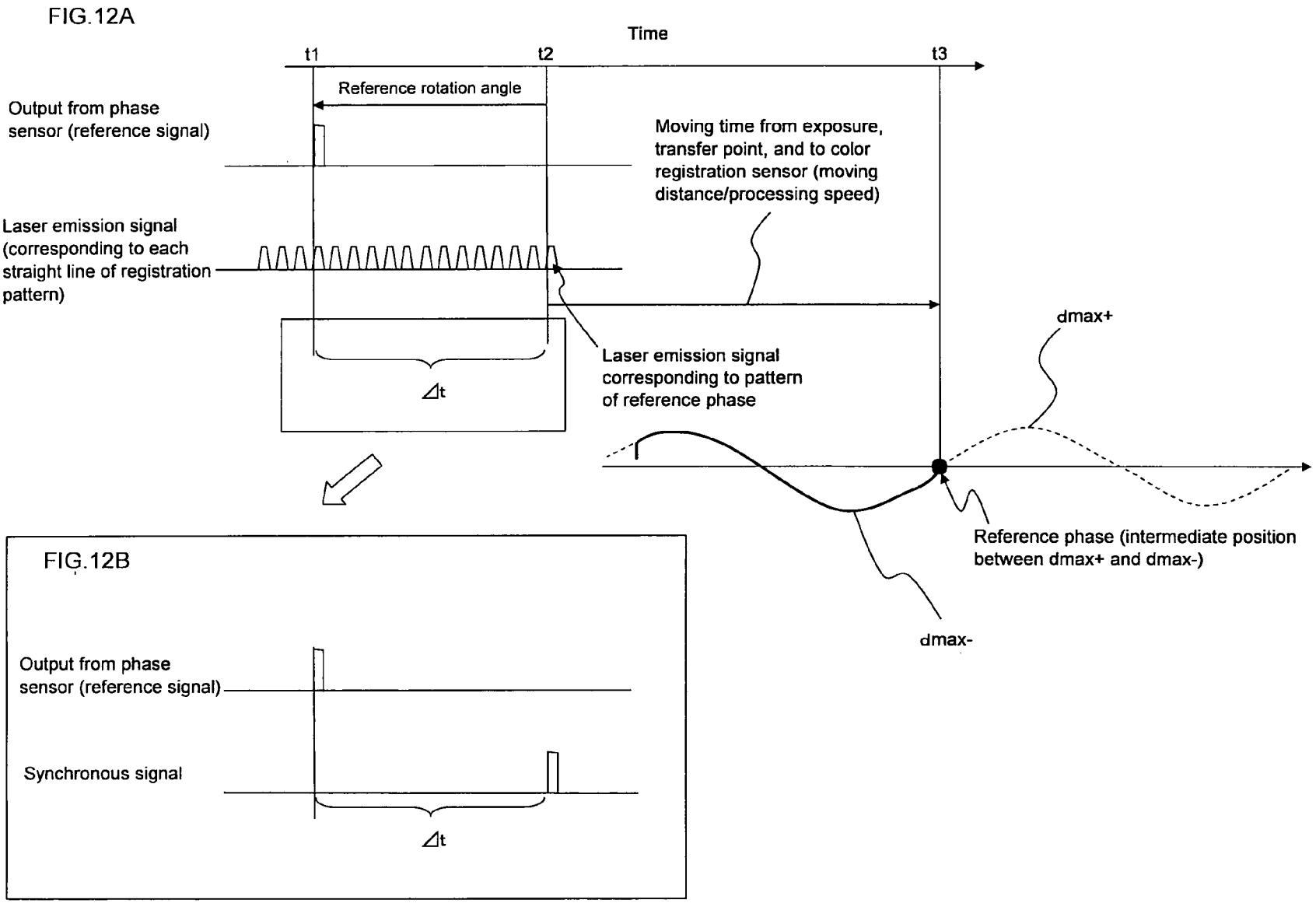
FIG.12A
Output from phase sensor (reference signal)
Laser emission signal (corresponding to each straight line of registration pattern)
t1
t2
t3
Time
Reference rotation angle
Moving time from exposure, transfer point, and to color registration sensor (moving distance/processing speed)
Laser emission signal corresponding to pattern of reference phase
Δt
dmax+
dmax-
Reference phase (intermediate position between dmax+ and dmax-)
FIG.12B
Output from phase sensor (reference signal)
Synchronous signal
Δt FIG.19 As for correction of K

FIG.22

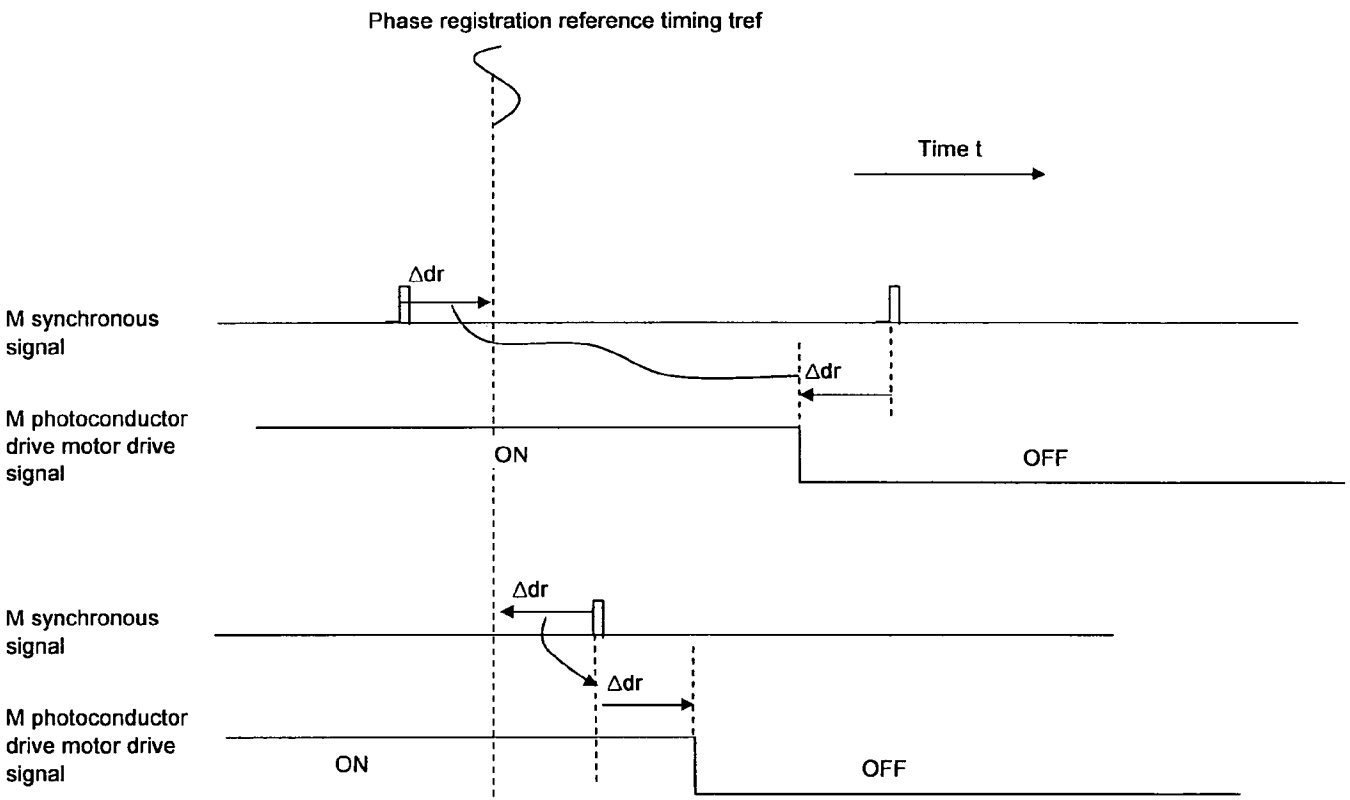

1 In case where synchronous signal advances from tref

Since rotation angle of photoconductor advances from reference, if photoconductor stops at next synchronous signal, it advances. Therefore, stopping position of photoconductor is advanced by advancing amount (Δdr) from synchronous signal to delay rotation.

2 In case where synchronous signal delays from tref

Since rotation angle of photoconductor delays from reference, if photoconductor stops at next synchronous signal, it delays. Therefore, stopping position of photoconductor is delayed by delay amount (Δdr) from synchronous signal to advance rotation.

COLOR REGISTRATION METHOD AND IMAGE FORMING APPARATUS

CROSS-REFERENCE TO RELATED APPLICATION

This application is related to Japanese patent application Nos. 2006-112604 and 2006-199733 which are filed on Apr. 14, 2006 and Jul. 21, 2006 respectively whose priorities are claimed under 35 USC §119, the disclosure of which are incorporated by reference in its entirety.

BACKGROUND OF THE INVENTION

1. Field of the Invention

The present invention relates to a color registration method and a color image forming apparatus.

2. Description of the Related Art

There has been known a color image forming apparatus (so-called tandem-type color image forming apparatus) having a plurality of drum-type photoconductors. In the color image forming apparatus, it is important to suppress the positional deviation for every color (color misregistration) to an unnoticeable degree. When the color misregistration is great, it might be evaluated that the image quality is deteriorated. The greatest factor of the color misregistration is a periodic crude density on the output image caused by the eccentricity of each photoconductor. The ideal countermeasure is that the eccentric amount of each photoconductor is sufficiently reduced, but trade-off between cost and mass-productivity should be considered.

In view of this, various ideas have been provided to make the color misregistration unnoticeable even if the eccentric amount is the same. For example, an apparatus in which the peripheral length of each photoconductor drum and the peripheral length of the transfer belt is set to have ratios of whole numbers has been proposed (for example, Japanese Patent Laid-Open No. 7-261499). Further, an apparatus has been known in which a mark formed on a transfer belt is detected and, when the detected position is outside the fixed range, this position is stored and the formation of the mark is inhibited at this position (for example, Japanese Patent Laid-Open No. 2004-294471).

When the phase (rotational phase) of the eccentricity of each photoconductor is not matched, the color misregistration becomes noticeable. This point is focused, and various ideas have been given for matching the rotational phase of each photoconductor on the output image so as to make the color misregistration unnoticeable. In this case, in order to detect the rotational phase of each photoconductor, a toner pattern (toner image) having lines, parallel to the rotational axis of the photoconductor, arranged at equal intervals in the rotating direction is formed, and the deviation from the expected position is detected.

However, the cause of the crude density of the output image, in other words, the cause of the deviation of the formed toner pattern from the expected position, exists in the factors other than the eccentricity of the photoconductor. Upon detecting the rotational phase, the causes other than the eccentricity of the photoconductor become a disturbance. A sufficient precision cannot always be obtained in the detection of the rotational phase of each photoconductor using the toner pattern due to the disturbances.

In order to precisely detect the rotational phase of each photoconductor, a technique for effectively removing the disturbance component has been desired.

The color image forming apparatus performs the image formation by using three primary colors of yellow, cyan, and magenta, and black. The tandem-type image forming apparatus includes four photoconductors corresponding to each color. In the case of the monochromatic image formation, only the black photoconductor is used.

It is preferable that the diameter of the black photoconductor is increased from the viewpoint of achieving high-speed monochromatic image formation, compared to the color image formation, and of prolonging the service life of the black photoconductor to make its exchange cycle same as that of the other photoconductors. However, if only the diameter of the black photoconductor is greater than the diameter of the other photoconductors, various subjects involved with the color image formation arise. The representative one is the subject relating to the color misregistration. Since the rotational cycle of the black photoconductor is different from those of the other photoconductors, the technique for aligning the direction of the eccentricity to make the color misregistration unnoticeable cannot be taken.

A technique for making the color misregistration unnoticeable with a simple configuration has been desired even in case where a plurality of types of photoconductors, each type having a different diameter, are used.

SUMMARY OF THE INVENTION

The present invention is accomplished in view of the aforesaid circumstances, and firstly provides a technique for effectively removing a disturbance component included in a toner pattern used for a color registration, in order to be capable of precisely adjusting the rotational phase of each photoconductor. Secondly, the present invention provides a technique for suppressing a variation in an image pitch corresponding to the rotational cycle of each photoconductor with a simple configuration, even if a plurality of types of photoconductors, each having a different diameter, are used, whereby a color misregistration is made unnoticeable.

In order to solve the aforesaid subjects, the present inventors have conducted diligent researches and found that the disturbance component also has periodicity. The factors of the periodicity are caused by the following means driving the image forming apparatus.

(1) In an image forming apparatus including a plurality of photoconductors each having a different diameter, a cycle corresponding to the peripheral length of a second photoconductor having a second diameter in case where a toner pattern of a first photoconductor having a first diameter is formed.

(2) A cycle of a transfer drive roller that drives a transfer belt for transferring the toner patterns formed on each photoconductor and superimposing the toner patterns.

Describing in detail the aforesaid (1), the second photoconductor having the second diameter is brought into contact with an intermediate transfer belt when the toner pattern of the first photoconductor having the first diameter is formed. It is considered that the friction force due to the contact applies unintentional drive force to the intermediate transfer belt, so that the moving speed of the intermediate transfer belt is changed.

It is considered that the aforesaid item (1) appears since the image forming apparatus includes photoconductors each having a different diameter, and a transfer roller is used for the transfer from the photoconductor to the transfer belt.

In order to solve the first subject, the present invention provides a color registration method to be executed by a computer, in a color image forming apparatus including a plurality of drum-type photoconductors, each photoconductor having a peripheral surface on which images in a predetermined color are formed, the predetermined color being different in each photoconductor, in which some or all of the photoconductors having the same diameter are drived to match pitch fluctuations which are contained in the images formed on the respective photoconductors and which correspond to a rotational cycle of the photoconductors, the method including: a first measurement step for forming a first registration image for each color and measuring formation positions of a plurality of predetermined portions in each registration image; a second measurement step for forming a second registration image for each color and measuring formation positions of a plurality of predetermined portions in each registration image; a calculation step for obtaining deviations of the formation positions of each of the predetermined portions measured in the first and second measurement steps, from a reference position, and for calculating the deviations of each portion for every photoconductor; a step for calculating a periodic fluctuation component corresponding to the rotational cycle of the photoconductor on which the registration images are formed on the basis of the calculated deviation for each registration image, so as to obtain phases thereof; and a step for adjusting a rotational phase of each photoconductor in order for the obtained phases matching to each other, wherein the first and second registration images are formed on the peripheral surface of the same photoconductor at a predetermined interval, and the predetermined interval is an interval in the rotating direction, which is set such that disturbance components in which a cycle is assumed beforehand, cancel with each other by calculating the deviation.

In order to solve the first subject from the different viewpoint, the present invention provides a color image forming apparatus including: a plurality of drum-type photoconductors in which first and second registration images are respectively formed on a peripheral surface of the same photoconductor; a measurement section for measuring formation positions of a plurality of predetermined portions in each of the formed registration images; a deviation calculating section for obtaining deviations of the measured formation positions of each of the predetermined portions from a reference position, and for calculating the deviations of each portion for every photoconductor; a phase determining section for calculating a periodic fluctuation component corresponding to a rotational cycle of the photoconductor on which the registration images are formed on the basis of the calculated deviation for each registration image, so as to obtain phases thereof; and an adjustment section for adjusting a rotational phase of each photoconductor in order for the obtained phases matching to each other, wherein the first and second registration images are formed on the peripheral surface of the same photoconductor at a predetermined interval, and the predetermined interval is an interval in the rotating direction, which is set such that disturbance components in which a cycle is assumed beforehand, cancel with each other by calculating the deviation.

Further, in order to solve the first and second subjects, the present invention provides an image forming apparatus including: a plurality of drum-type photoconductors in which first and second registration images are respectively formed on a peripheral surface of the same photoconductor; a plurality of drive sections for rotatably driving each photoconductor at a predetermined drive speed; a measurement section for measuring formation positions of a plurality of predetermined portions in each of the formed registration images; a deviation calculating section for obtaining deviations of the measured formation positions of each of the predetermined portions from a reference position, and for calculating the deviations of each portion for every photoconductor; a phase determining section for calculating a periodic fluctuation component corresponding to a rotational cycle of the photoconductor on the basis of the calculated deviation for each registration image, so as to obtain phases thereof; an adjustment section for adjusting a rotational phase of each photoconductor in order for phases of speed fluctuation of each photoconductor matching to each other on the basis of the obtained phases; a correction signal output section for outputting a speed correction signal that is included in each of the formed images for correcting the fluctuation component corresponding to the rotational cycle of each photoconductor; and a drive control section for controlling the drive sections to correct the drive speed of each photoconductor by using the outputted speed correction signal, wherein the first and second registration images are formed on the peripheral surface of the same photoconductor at a predetermined interval, the predetermined interval is an interval in the rotating direction, which is set such that disturbance components in which a cycle is assumed beforehand, cancel with each other by calculating the deviation, and the speed correction signal is a signal having a cycle equal to the rotational cycle of each photoconductor.

BRIEF DESCRIPTION OF THE DRAWINGS

FIGS. 12A and 12B are explanatory views for explaining the relationship between a reference rotation angle and a reference phase in the image forming apparatus according to the present invention;

FIG. 22 is an explanatory view showing the state in which the control section 40*a* adjusts the rotational phase in the event that an M synchronous signal advances or delays with respect to a reference signal tref (corresponding to a Y synchronous signal in FIG. 23)

DESCRIPTION OF THE PREFERRED EMBODIMENT

Figure 16:
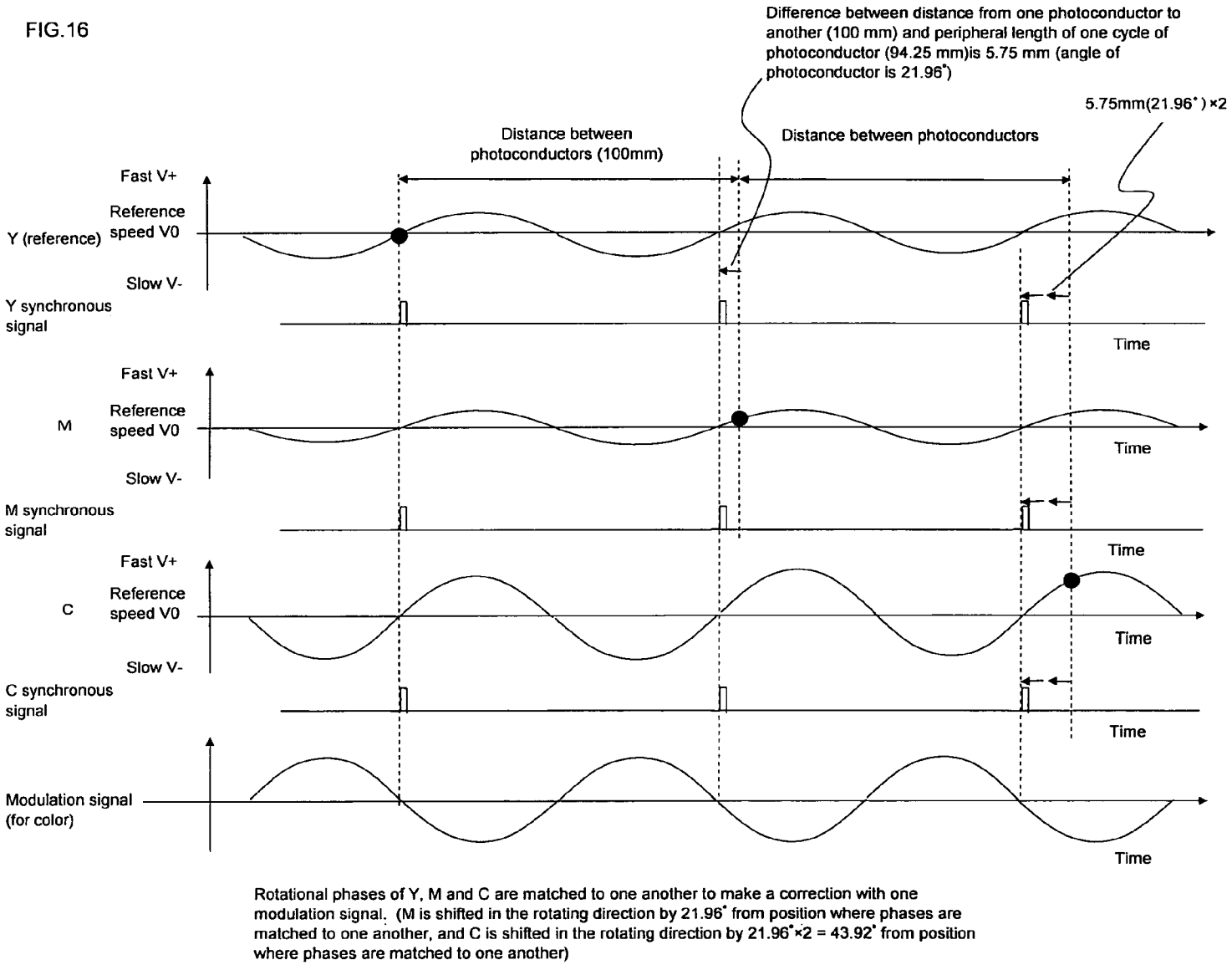
FIG. 16 is an explanatory view showing the peripheral speed fluctuation component of the photoconductor in the state in which the rotational phases of each photoconductor drum 3 match to each other in the image forming apparatus according to the present invention.

In the present invention described above, the state in which the phases of the speed variation of each photoconductor match to each other means, for example, the state in which the times when the maximum point and minimum point of the variation in the peripheral speed of each photoconductor at the exposure position respectively match to each other. FIG. 16 described later shows an example in which each of YMC photoconductor drums is in this state.

In other words, the present invention performs the following with respect to the first subject.

(1) A first toner pattern is formed on a transfer belt, and the position of the formed toner pattern is measured to calculate a misregistration amount (deviation) 1 from the expected position.

(2) Then, a second toner pattern is formed at the position from the first toner pattern at a predetermined interval in the transporting direction of the transfer belt. The position of the formed second toner pattern is measured to calculate a misregistration amount 2 from the expected position.

(3) Next, the calculated misregistration amount 1 and the misregistration amount 2 are totaled to calculate a final misregistration amount. In this case, the predetermined interval is set such that the misregistration amount caused by the periodic disturbance factor is produced inversely in the misregistration amount 1 and the misregistration amount 2. By virtue of this configuration, the misregistration amount caused by the periodic fluctuation factor is in the direction in which it is canceled by the final misregistration amount, whereby its influence is prevented.

Thus, the rotational phase of the photoconductor can precisely be detected.

With respect to the first subject, the color registration method according to the present invention includes a first measurement step for forming a first registration image for each color and measuring the formation position of a plurality of predetermined portions in each registration image, and a second measurement step for forming a second registration image for each color and measuring the formation position of a plurality of predetermined portions in each registration image, wherein the first and second registration images are formed on the same photoconductor at a predetermined interval, and the predetermined interval is set such that disturbance components in which a cycle is presumed beforehand, cancel with each other by the calculation of the deviation.

Further, with respect to the first subject, the image forming apparatus according to the present invention includes a plurality of drum-type photoconductors, on which a first and a second registration images are formed on the surface of the same photoconductor, and a measurement section for measuring the formation position of a plurality of predetermined portions in each registration image, wherein the predetermined interval is set such that disturbance components in which a cycle is presumed beforehand, cancel with each other by the calculation of the deviation.

According to the aforesaid configuration, a plurality of color registration toner patterns (hereinafter simply referred to as toner patterns) are formed at the predetermined interval by which the periodic disturbances having a cycle different from the predetermined cycle cancel with each other, and the phase of the fluctuation component in the predetermined cycle can be obtained for each image, whereby the disturbance can effectively be suppressed with less number of toner patterns, and the phase of the fluctuation component in the predetermined cycle can precisely be obtained. From another viewpoint, the disturbance can be suppressed with less number of toner patterns, whereby the time taken for the image formation and measurement can also be shortened.

Although the above-mentioned case describes that the photoconductor has a drum shape, the present invention is applicable to a belt-like photoconductor, for example. In this case, the eccentricity of the photoconductor drive roller for driving the belt-like photoconductor becomes the cause of the periodic crude density. Therefore, the drum-type photoconductor may be replaced with the photoconductor drive roller. For example, the cycle to be measured may be a cycle corresponding to the peripheral length of the photoconductor drive roller, and the rotational phase of each photoconductor drive roller may be adjusted by measuring the toner pattern.

One example of a transfer member is the intermediate transfer belt on which the toner image formed on the photoconductor is transferred. The embodiment described later describes an image forming apparatus having such intermediate transfer belt. However, there is the one, in the tandem-type color image forming apparatus, in which the toner image formed on the photoconductor is directly transferred onto a print sheet. In this type of apparatus, the transfer belt directly supports and transports the sheet. The toner image is transferred onto the sheet transported by the transfer belt. The present invention is applicable to this type of image forming apparatus. In this case, the toner pattern to be measured may be formed on the sheet. Alternatively, in so far as the toner pattern to be measured, it may directly be transferred onto the transfer belt.

In the color registration method according to the present invention, each registration image may include a plurality of straight lines orthogonal to the rotating direction of the photoconductor, and each of the measurement steps may measure a formation position of each straight line.

The image forming apparatus may further include a transferring member for transferring each of the formed images, and a drive roller for superimposing the images in each color by moving the transferring member between the photoconductors, wherein the predetermined interval may be an interval in the rotating direction, which is set such that periodic disturbances corresponding to the rotational cycle of the drive roller cancel with each other.

Further, the predetermined interval may be an interval between front ends of each of the registration images or between rear ends of each of the registration images, and may be an interval substantially equal to the integral multiple of the peripheral length of the photoconductor and to the sum of the integral multiple of the peripheral length of the drive roller and its half rotation, and the calculation step may make a calculation by obtaining the sum of the deviations of each corresponding portion of the registration images.

Alternatively, the predetermined interval may be substantially equal to the sum of the integral multiple of the peripheral length of the photoconductor and its half rotation and to the integral multiple of the peripheral length of the drive roller, and the calculation step may make a calculation by obtaining the difference between the deviations of each corresponding portion of the registration images.

Moreover, in the color registration method according to the present invention, the image forming apparatus may include a first photoconductor having a first diameter and a second photoconductor having a second diameter, the registration images are formed on the first photoconductor, and the predetermined interval may be set such that periodic disturbances corresponding to the rotational cycle of the second photoconductor cancel with each other.

Further, the predetermined interval may be substantially equal to the integral multiple of the peripheral length of the first photoconductor and to the sum of the integral multiple of the peripheral length of the second photoconductor and its half rotation, and the calculation step may make a calculation by obtaining the sum of the deviations of each corresponding portion of the registration images.

Alternatively, the predetermined interval may be substantially equal to the sum of the integral multiple of the peripheral length of the first photoconductor and its half rotation and to the integral multiple of the peripheral length of the second photoconductor, and the calculation step may make a calculation by obtaining the difference between the deviations of each corresponding portion of the registration images.

Further, in the color registration method according to the present invention, the image forming apparatus may include a first photoconductor having a first diameter and a second photoconductor having a second diameter, the registration images are formed on the first photoconductor, and the predetermined interval may be set such that periodic components corresponding to the peripheral length of the second photoconductor cancel with each other, and periodic components corresponding to the peripheral length of a drive roller cancel with each other.

Moreover, the predetermined interval may be substantially equal to the integral multiple of the peripheral length of the first photoconductor, to the sum of the integral multiple of the peripheral length of the second photoconductor and its half rotation, and to the sum of the integral multiple of the peripheral length of the drive roller and its half rotation, and the calculation step may make a calculation by obtaining the sum of the deviations of each corresponding portion of the registration images.

Alternatively, the predetermined interval may be substantially equal to the sum of the integral multiple of the peripheral length of the first photoconductor and its half rotation, to the integral multiple of the peripheral length of the second photoconductor, and to the integral multiple of the peripheral length of the drive roller, and the calculation step makes a calculation by obtaining the difference between the deviations of each corresponding portion of the registration images.

Further, the image forming apparatus according to the present invention may further include a transferring member for transferring each of the formed images, and a drive roller for superimposing the images in each color by moving the transferring member between the photoconductors, wherein the predetermined interval may be an interval which is set such that periodic disturbances corresponding to the rotational cycle of the drive roller cancel with each other.

Further, a plurality of the drum-type photoconductors may include a first photoconductor having a first diameter and a second photoconductor having a second diameter, the registration images may be formed on the first photoconductor, and the predetermined interval may be set such that periodic components corresponding to the peripheral length of the second photoconductor cancel with each other, and periodic components corresponding to the peripheral length of a drive roller cancel with each other.

Moreover, the image forming apparatus for solving the first and second subjects according to the present invention may include: a plurality of drum-type photoconductors in which first and second registration images are respectively formed on a peripheral surface of the same photoconductor; a plurality of drive sections for rotatably driving each photoconductor at a predetermined drive speed; a measurement section for measuring formation positions of a plurality of predetermined portions in each of the formed registration images; a deviation calculating section for obtaining deviations of the measured formation positions of each of the predetermined portions from a reference position, and for calculating the deviations of each portion for every photoconductor; a phase determining section for calculating a periodic fluctuation component corresponding to a rotational cycle of the photoconductor on the basis of the calculated deviation for each registration image, so as to obtain phases thereof; an adjustment section for adjusting a rotational phase of each photoconductor in order for phases of speed fluctuation of each photoconductor matching to each other on the basis of the obtained phases; a correction signal output section for outputting a speed correction signal that is included in each of the formed images for correcting the fluctuation component corresponding to the rotational cycle of each photoconductor; and a drive control section for controlling the drive sections to correct the drive speed of each photoconductor by using the outputted speed correction signal, wherein the first and second registration images may be formed on the peripheral surface of the same photoconductor at a predetermined interval, the predetermined interval may be an interval in the rotating direction, which is set such that disturbance components in which a cycle is assumed beforehand, cancel with each other by calculating the deviation, and the speed correction signal may be a signal having a cycle equal to the rotational cycle of each photoconductor.

Further, in the image forming apparatus according to the present invention, the photoconductors may include a plurality of types having different diameters, and the speed correction signal may be a signal having a cycle equal to the rotational cycle of each photoconductor according to the diameter.

The image forming apparatus may further include: a registration image forming section for forming the registration images composed of a plurality of patterns on each photoconductor; a fluctuation component calculating section for calculating an amplitude and a phase of a pitch fluctuation component corresponding to the rotational cycle of the photoconductor from a measurement result of each pattern; and a correction signal generating section for generating the speed correction signal having a cycle equal to the rotational cycle on the basis of the calculated amplitude and phase for every diameter.

Further, in the image forming apparatus according to the present invention, the speed correction signal may be common to the photoconductors having the same diameter.

The image forming apparatus according to the present invention may further include: a transferring member for transferring the images formed by each photoconductor, and a rotational phase adjustment section for adjusting the rotational phase of the photoconductor, wherein each photoconductor may be composed of a black image forming photoconductor having a diameter of a first size and a plurality of color image forming photoconductors having a diameter of a second size, and each photoconductor may be arranged along the transferring member at a predetermined interval, and the rotational phase adjustment section may determine the rotational phase of each of the color image forming photoconductors on the basis of the calculated phase so that the phases of the pitch fluctuation component included in the image formed by the respective color image forming photoconductors and transferred to the transferring member are matched to each other, and may adjust the rotational phase of each of the color image forming photoconductors in such a manner that the respective rotational phases are shifted from the respective determined rotational phases at an angle determined beforehand according to the interval so as to align the rotational phases of the respective color image forming photoconductors.

The present invention will be explained in detail with reference to drawings. It is possible to better understand the present invention from the explanation described below. Notably, the explanation described below should be considered to be only illustrative, and not restrictive in all aspects.

(Outline of Image Forming Apparatus)

In the present embodiment, the outline of the mechanical structure of a color image forming apparatus according to one embodiment of the present invention will be explained.

Figure 2:
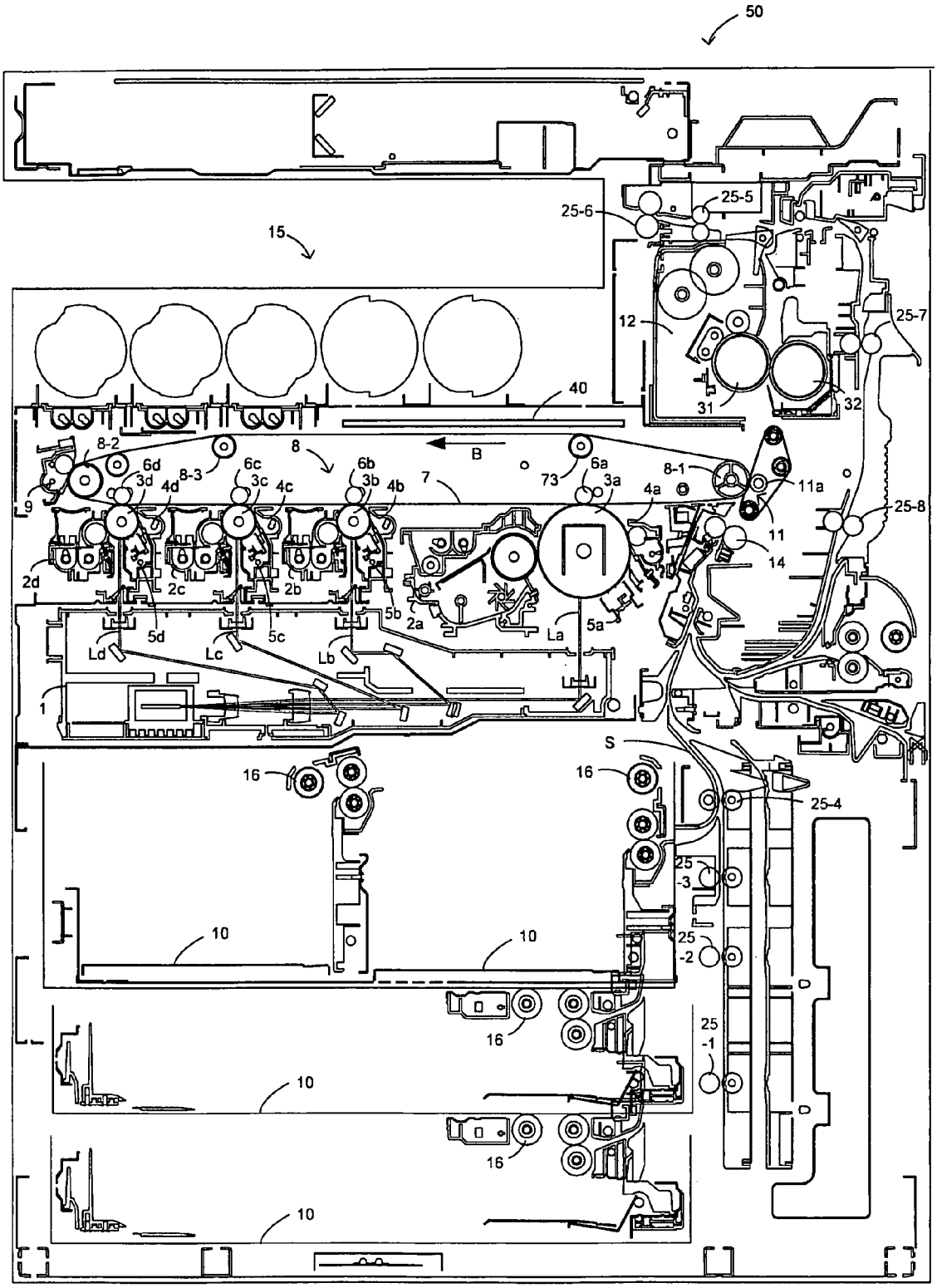
FIG. 2 is a sectional view showing a configuration of an image forming apparatus according to the present invention.

FIG. 2 is a sectional view showing the configuration of the image forming apparatus according to the present invention. The image forming apparatus 50 forms a multicolor image or monochrome image to a predetermined sheet in accordance with image data externally transmitted. As shown in the figure, the image forming apparatus 50 is an electrophotographic image forming apparatus composed of an exposure unit 1, developing units 2, photoconductor drums 3, chargers 5, cleaner units 4, an intermediate transfer belt unit 8, a fuser unit 12, a sheet transporting path S, a sheet feeding tray 10, a sheet exit tray 15, and the like.

The image data handled by the image forming apparatus is in accordance with a color image using each of black (K), cyan (C), magenta (M), and yellow (Y). Therefore, four developing units 2 (2*a*, 2*b*, 2*c*, 2*d*), four photoconductor drums 3 (3*a*, 3*b*, 3*c*, 3*d*), four chargers 5 (5*a*, 5*b*, 5*c*, 5*d*), and four cleaner units 4 (4*a*, 4*b*, 4*c*, 4*d*) are provided according to each color. The alphabets appended to each numeral represent such that "a" corresponds to black, "b" corresponds to cyan, "c" corresponds to magenta, and "d" corresponds to yellow. Four types of latent images are formed at the peripheral surface of each of the photoconductor drums 3. Specifically, four image stations are provided corresponding to each color.

The configuration of one of the image stations will be explained as the representative of four image stations. The other image stations have the same configuration. Accordingly, the alphabets appended to each numeral are omitted. The charger 5 is a charging means for uniformly charging the surface of the photoconductor drum 3 with a predetermined potential. Examples of the charging means include a brush-type charger and a charger-type charger in addition to a contact-type roller as shown in FIG. 2.

The exposure unit 1 is an exposure means for selectively exposing the surface of the charged photoconductor. As the exposure means, a writing head in which light-emitting devices such as EL or LED are arranged in an array may be used instead of the laser scanning unit (LSU) shown in FIG. 2. The LSU 1 has a laser irradiating section and a polygon mirror. The LSU 1 reflects a laser beam L from the laser irradiating section to the rotating polygon mirror so as to deflect the laser beam L, thereby scanning the surface of the photoconductor.

The laser beam L is modulated in accordance with the image data produced by reading a document or produced by a computer.

The photoconductor drum 3 charged by the laser beam L modulated with the image data is scanned and exposed, whereby an image having a potential corresponding to the image data (electrostatic latent image) is formed on the surface of the photoconductor drum 3. The developing unit 2 develops the latent image formed on the photoconductor drum 3 (makes the latent image formed on the photoconductor drum 3 visible) with a toner of any one of colors of K, C, M, and Y. The cleaner unit 4 removes and collects the residual toner on the surface of the photoconductor drum 3 after the image is developed and transferred as described below.

The intermediate transfer belt unit 8 is arranged above the photoconductor drum 3. The intermediate transfer belt unit 8 includes an intermediate transfer belt 7, an intermediate transfer belt drive roller 8-1, an intermediate transfer belt tension mechanism 8-3, an intermediate transfer belt driven roller 8-2, an intermediate transfer roller 6 (6*a*, 6*b*, 6*c*, 6*d*), and an intermediate transfer belt cleaning unit 9.

The intermediate transfer belt drive roller 8-1, the intermediate transfer belt tension mechanism 8-3, the intermediate transfer roller 6, the intermediate transfer belt driven roller 8-2, and the like stretch the intermediate transfer belt 7 and drive the same to rotate in the direction shown by an arrow B.

The intermediate transfer roller 6 is rotatably supported at an intermediate transfer roller mounting section of the intermediate transfer belt tension mechanism 8-3 at the intermediate transfer belt unit 8. A transferring bias voltage for transferring the toner image formed on the photoconductor drum 3 to the intermediate transfer belt 7 is applied to the intermediate transfer roller 6.

The intermediate transfer belt 7 is provided to be in contact with the respective photoconductor drums 3. The toner image in each color formed on the surface of the photoconductor drum 3 is successively transferred to the intermediate transfer belt 7 by the transferring bias voltage applied to the intermediate transfer roller 6. Thus, a color toner image (multi-color toner image) is transferred onto the intermediate transfer belt 7 in a multi-layered manner. The intermediate transfer belt 7 is made by forming a film having a thickness of about 100 μm to 150 μm into an endless shape.

As described above, the intermediate transfer roller 6 is in contact with the back side of the intermediate transfer belt 7, and it is a transferring means for transferring the toner image onto the intermediate transfer belt 7 from the photoconductor drum 3. A transferring bias voltage of about several hundred volts (the voltage having a polarity (+) opposite to the charging polarity (−) of toner) for transferring the toner image is applied to the intermediate transfer roller 6.

The intermediate transfer roller 6 has a metallic (for example, stainless) shaft having a diameter of 8 to 10 mm as a base. A conductive elastic member (for example, EPDM, urethane foam) is covered on its surface. The conductive elastic member makes it possible to apply a generally uniform voltage to the intermediate transfer belt. In this embodiment, a manual transfer roller is used as the transferring means. However, in addition to this configuration, a brush-type transfer electrode (transfer brush) may be brought into contact with the back side of the intermediate transfer belt 7 for use as the transferring means.

The toner image transferred onto the intermediate transfer belt 7 moves to a transfer section 11, where the transfer roller 11*e* is arranged, with the rotation of the intermediate transfer belt 7.

The intermediate transfer belt 7 and the transfer roller 11*e* are brought into pressing contact with each other with a nip of a predetermined width. Further, a bias voltage (high voltage having a polarity (+) opposite to the charging polarity (−) of toner) for transferring the toner image onto a later-described sheet is applied to the transfer roller 11*e*. Either one of the transfer roller 11*e* and the intermediate transfer belt drive roller 8-1 is made of a hard material (metal or the like), and the other one is an elastic roller in which the surface of a core metal is covered by a soft material (elastic rubber roller, foaming-resin roller or the like). This can constantly provide a nip of a predetermined width.

The toner is adhered onto the intermediate transfer belt 7 at an area other than the area where the image is transferred onto the sheet by the contact with the photoconductor drum 3. Further, there exists a toner that is not transferred onto the sheet by the transfer roller 11*e* to remain on the intermediate transfer belt 7. These toners might cause the toner colors to be mixed in the subsequent processes. Thus, the intermediate transfer belt cleaning unit 9 is provided to remove and collect the toners on the intermediate transfer belt 7. The intermediate transfer belt cleaning unit 9 is provided with a cleaning blade serving as a cleaning member, the end of which is in contact with the intermediate transfer belt 7 for removing the toners. The portion of the intermediate transfer belt 7 in a portion where the intermediate transfer belt cleaning unit 9 is in contact with the intermediate transfer belt 7 is supported by the intermediate transfer belt driven roller 8-2 from the back side.

On the sheet feeding tray 10, sheets used for the image formation are stacked. The sheet feeding tray 10 is disposed below the exposure unit 1 of the image forming apparatus 50. On the other hand, the sheet exit tray 15 is disposed at an upper part of the image forming apparatus 50. On the sheet exit tray 15, printed sheets are ejected and stacked in such a way that the printed sides face downward.

Further, the image forming apparatus 50 is provided with the sheet transporting path S, having generally a perpendicular shape, through which a sheet on the sheet feeding tray 10 is conveyed to the sheet exit tray 15 via the transfer section 11 and the fuser unit 12. In the vicinity of the sheet transporting path S between the sheet feeding tray 10 and the sheet exit tray 15, for example a pick-up roller 16, a registration roller 14, the transfer section 11, the fuser unit 12, and transport rollers 25 (25-1 to 25-8) for transporting the sheet are disposed.

A plurality of transport rollers 25-1 to 25-4 are small rollers that facilitate and support conveying of the sheets and are provided along the sheet transporting path S. The pick-up roller 16 is disposed at an end portion of the sheet feeding tray 10, and conveys sheets, one by one, from the sheet feeding tray 10 to the sheet transporting path S.

The registration roller 14 temporarily holds the sheet being conveyed through the sheet transporting path S at a predetermined position. The registration roller 14 has a function of conveying the sheet to the transfer section 11 at such timing that the front end of the toner image formed on the intermediate transfer belt 7 is synchronized with the front end of the sheet.

The fuser unit 12 is provided with, for example, a heat roller 31 and a pressure roller 32. The heat roller 31 and the pressure roller 32 rotate with a sheet which is sandwiched between them.

The heat roller 31 is controlled by a control section of a control substrate 40 such that an unillustrated heater arranged in the heat roller 31 has a predetermined fusing temperature on the basis of a signal from a temperature detection unit (not illustrated). The heat roller 31 and the pressure roller 32 apply heat and pressure to the sheet, which is passed between the heat roller 31 and the pressure roller 32, so that the color toner images transferred onto the sheet are melted, mixed, and pressed. As a result, the color toner images are heat fused with the sheet.

The sheet with the fixed multi-color toner image is transported, by the transport rollers 25-5 and 25-6, to a reversed-sheet exit path of the sheet transporting path S. Then, the sheet, which has been reversed upside down (the multi-color toner image is facing downward), is ejected to the sheet exit tray 15.

Next, the sheet transporting path will be explained in detail. A sheet cassette 10 for accommodating sheets beforehand is provided in the image forming apparatus.

The sheet feeding tray 10 is provided with the corresponding pick-up roller 16, at its end portion, that supplies the sheets, one by one, to the sheet transporting path.

The sheet conveyed from the sheet feeding cassette 10 is conveyed to the registration roller 14 by the transport rollers 25-1 to 25-4 disposed on the sheet transporting path and then stops. The registration roller 14 sends the sheet to the transfer section 11 at such timing that the front end of the sheet meets the front end of the toner image on the intermediate transfer belt 7. At the transfer section 11, the toner image on the intermediate transfer belt 7 is transferred onto the sent sheet. Thereafter, the toner image passes the fuser unit 12. At this time, the non-fixed toner on the sheet is fused by heat, naturally cooled after passing through the fuser unit 12, and then, fixed onto the sheet. Then, the sheet is conveyed to the transport roller 25-5, then, to the sheet exit roller 25-6 and finally, ejected to the sheet exit tray 15.

The control substrate 40 is arranged below the sheet exit tray 15. The control substrate 40 has a microcomputer for controlling the operation of each section of the image forming apparatus 50, a ROM for storing a control program executed by the microcomputer, and a RAM for providing a working area for the process of the microcomputer and a storage area of image data. The microcomputer executes the control program to function as a control section. The above-described image formation, transfer of toner image, transport of sheet, temperature control of the fuser unit, and the like are realized by the function of the control section.

The control substrate has an input circuit and an output circuit. Inputted to the input circuit are signals from the sensors arranged at each section in the image forming apparatus 50, whereby the microcomputer can perform the processing by using the inputted signals. The output circuit is the one for outputting a signal for driving loads arranged at each section.

(Procedure 1 of Color Registration—Measurement of Misregistration Amount)

Figure 3:
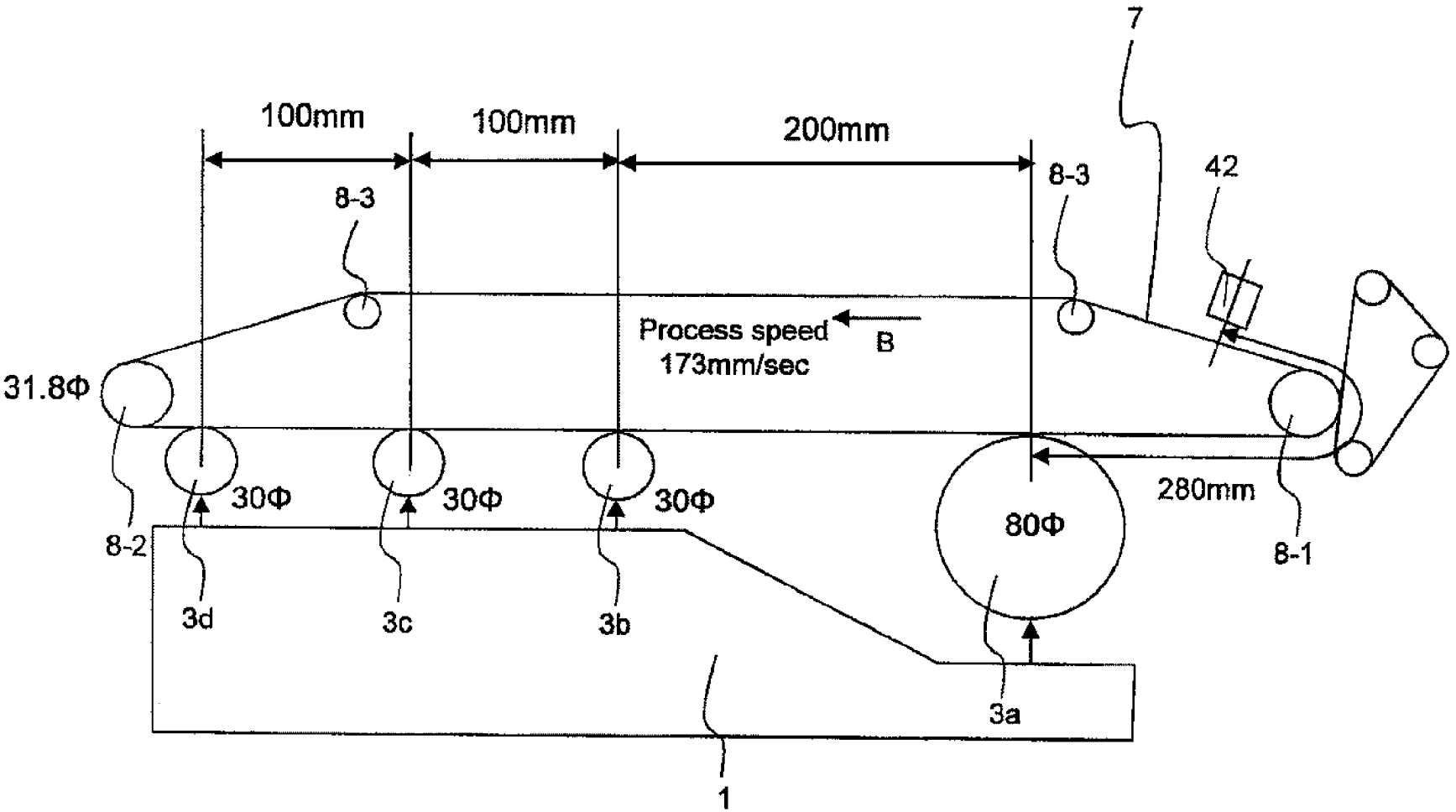
FIG. 3 is an explanatory view in which the portion relating to the color registration is calculated from the image forming apparatus shown in FIG. 2.

FIG. 3 is an explanatory view in which the portions relating to the explanation for the color registration is calculated from the image forming apparatus shown in FIG. 2. As described above, the intermediate belt 7 is driven by the transfer belt drive roller 8-1 to move in the direction of the arrow B. In the present embodiment, the diameter of the transfer belt drive roller 8-1 is 31.8 mm. A Y photoconductor drum 3*d*, an M photoconductor drum 3*c*, a C photoconductor drum 3*b*, and a K photoconductor drum 3*a* are arranged along the moving direction of the intermediate transfer belt 7. Each of Y, M, and C photoconductor drums has a transfer point that is in contact with the intermediate transfer belt 7.

The diameter of each of Y, M, and C photoconductor drums is 30 mm, and the diameter of the K photoconductor drum 3*a* is 80 mm. The difference in the diameter depends upon the design conditions such as a service life of the photoconductor, a processing speed (the moving speed of the surface of the photoconductor and the intermediate transfer belt 7 upon the image formation), and the like. The processing speed upon the color image formation in which the color misregistration becomes a significant problem is 173 mm/sec. The distance between the transfer point of the Y photoconductor drum 3*d* and the transfer point of the M photoconductor drum 3*c*, and the distance between the transfer point of the Y photoconductor drum 3*d* and the transfer point of the C photoconductor drum 3*b* are respectively 100 mm. The distance between the transfer point of the C photoconductor drum 3*b* and the transfer point of the K photoconductor drum 3*a* is 200 mm.

A color registration sensor 42 for measuring the color misregistration is arranged at a 280 mm downstream side of the transfer point of the K photoconductor drum 3*a*. The color registration sensor 42 is an optical sensor for reading a toner pattern transferred onto the intermediate transfer belt 7. The read signal is inputted to the input circuit of the control substrate and processed by the control section.

Figure 4A:
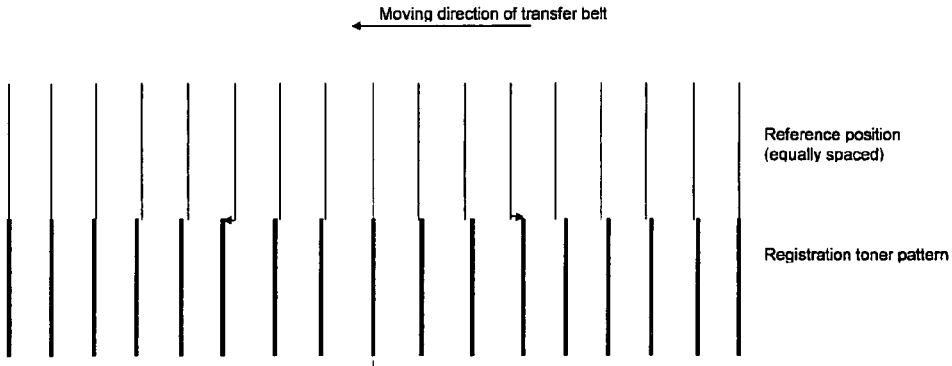
FIGS. 4A to 4C are explanatory views showing one example of a toner pattern according to the present invention.
Figure 4B:
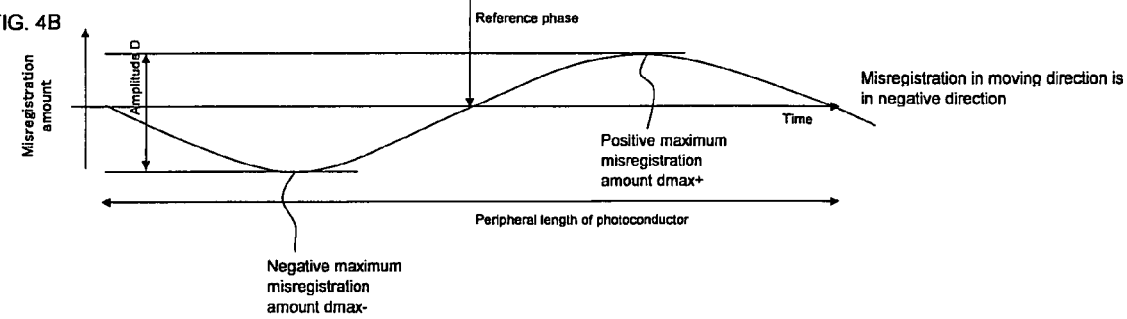
Figure 4C:
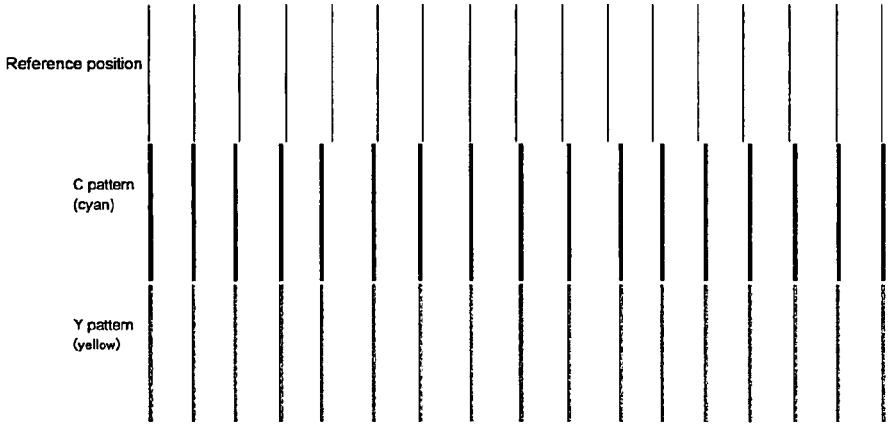

FIGS. 4A to 4C are explanatory views showing one example of the color registration toner pattern. FIG. 4A is an explanatory view for explaining the toner pattern of one color and a concept of the measurement using this pattern. FIG. 4B is a graph showing the misregistration amount of each straight line, constituting the toner pattern, from the reference position with the read time by the color registration sensor 42 taken as an axis of abscissa:. FIG. 4C shows patterns of two colors, i.e., C and Y. The coincidence of these phases means that the color misregistration is unnoticeable.

A plurality of (seventeen in FIG. 4A) parallel lines illustrated as a "registration toner pattern" are actually formed on the intermediate transfer belt 7 in FIG. 4A. Each straight line extends in the direction orthogonal to the moving direction of the intermediate transfer belt 7. It is preferable that the distance from the straight line at the head of the seventeen straight lines to the last straight line corresponds to the peripheral length of the photoconductor drum 3, i.e., the distance corresponding to one rotation of the photoconductor drum 3.

When the pattern shown in FIG. 4A passes through the reading point of the color registration sensor 42, the control section samples the timing when each straight line is read. Then, the control section obtains the misregistration amount from a reference clock at the read timing of each sampled straight line. The reference clock is a clock corresponding to the reference position shown in FIG. 4A. The reference clock has an equal pitch. As described above, FIG. 4B shows a graph in which the axis of abscissa represents the reading time and the axis of ordinate represents the misregistration amount.

(Procedure 2 of Color Registration—Acquiring Phase of Main Fluctuation Component)

The control section obtains the periodic fluctuation phase corresponding to the peripheral length of the photoconductor drum 3, on which the toner pattern is formed, from the misregistration amount obtained for each straight line. This is because that the greatest cause for producing the misregistration amount is experientially found to be the eccentricity of the photoconductor.

FIGS. 13A to 13E are explanatory views for explaining that the image pitch varies with respect to the reference pitch at the exposure position and the transfer position due to the eccentricity of the photoconductor in this embodiment.

Figure 13A:
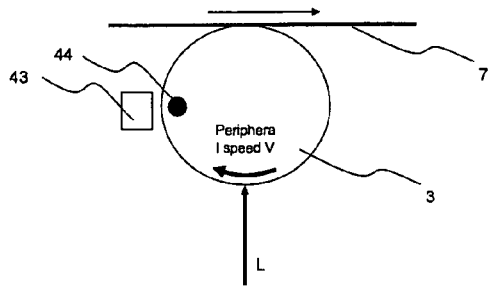
FIGS. 13A to 13E are explanatory views for explaining that the image pitch is fluctuated with respect to the reference pitch at an exposure position and a transfer position due to the eccentricity of the photoconductor in the image forming apparatus according to the present invention.

As shown in FIG. 13A, a scanning exposure is performed by laser beam to the peripheral surface of the photoconductor drum 3 at its generally lowermost point, whereby an electrostatic latent image is formed. The formed electrostatic latent image is developed by toner. When the peripheral surface reaches the transfer position at generally the uppermost position, which is after the half rotation of the photoconductor drum 3 after the scanning exposure, the developed toner image is transferred onto the intermediate transfer belt 7.

Figure 13B:
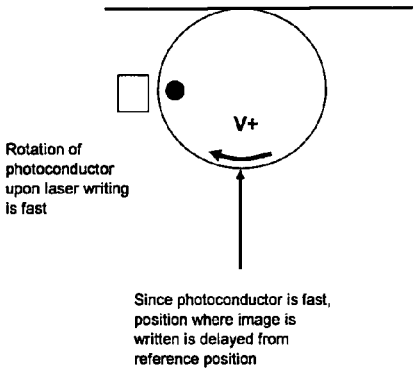
Figure 13C:
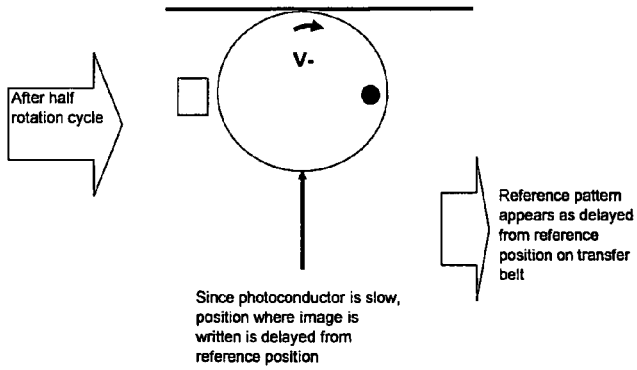

As shown in FIG. 13B, when the peripheral speed at the exposure position is faster than the reference speed, the pitch of the electrostatic latent image formed by the exposure increases than the reference pitch. As shown in FIG. 13C, when the exposed peripheral surface reaches the transfer position, the rotational phase of the photoconductor drum 3 increases by about 180 degrees, so that the peripheral speed is slower than the reference speed. Therefore, the pitch of the toner image transferred onto the intermediate transfer belt 7 increases more than the pitch of the toner image before the transfer.

Figure 13D:
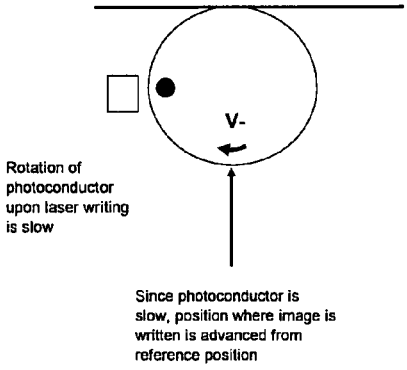
Figure 13E:
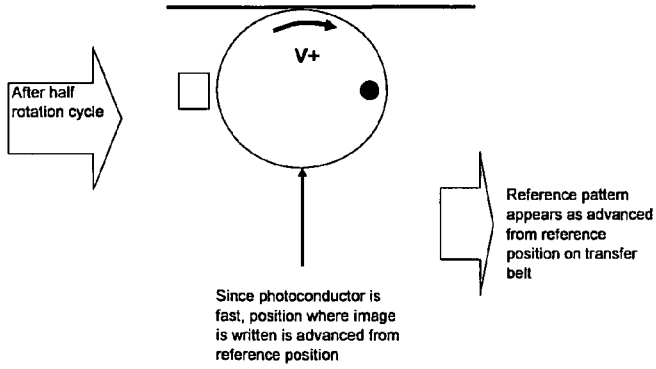

On the contrary, when the peripheral speed at the exposure position is slower than the reference speed as shown in FIG. 13D, the peripheral speed at the transfer position becomes fast, so that the image pitch of the transferred toner image is decreased as shown in FIG. 13E.

FIG. 4B is a graph in which an axis of ordinate represents the misregistration amount of each straight line.

The control section obtains the phase of the periodic fluctuation corresponding to the peripheral length of the photoconductor drum 3, on which the toner pattern is formed, from the misregistration amount obtained for each straight line.

FIG. 4B is a graph in which an axis of ordinate represents the misregistration amount of each straight line. In FIG. 4B, the positive maximum misregistration amount is $d_{max+}$, and the negative maximum misregistration amount is $d_{max-}$. The control section obtains the phase of the periodic fluctuation corresponding to the peripheral length of the photoconductor drum 3 from the change of the misregistration amount. The example of obtaining the phase is as follows. First, the maximum value $d_{max+}$ and the minimum value $d_{max-}$ of each misregistration amount are obtained. The difference between the obtained positive maximum misregistration amount $d_{max+}$ and the negative maximum misregistration amount $d_{max-}$ becomes an amplitude value D. The phase is obtained such that the intermediate position of the positive maximum misregistration amount $d_{max+}$ and the negative maximum misregistration amount $d_{max-}$ is defined as the reference phase. The reference phase is defined at the point where the difference becomes zero during the change of the misregistration amount from negative to positive. In FIG. 4B, the ninth straight line from the head of the test pattern is obtained as the reference phase.

It is to be noted that, in the present embodiment, the "misregistration amount" is a numeral with a positive or negative sign corresponding to the result of the measurement of each straight line in the toner pattern. Specifically, each misregistration amount is a value indicating the misregistration from the reference position. The positive or negative sign indicates the direction of the misregistration. For example, the "positive" sign represents the direction in which each straight line delays from the reference position (see FIGS. 4A and 4B). The "pitch fluctuation component" corresponds to the time-sequential set of the misregistration amount. Although each misregistration amount is only one numerical value, the pitch fluctuation component that is the time-sequential set has periodic change. Accordingly, the pitch fluctuation component has a phase and amplitude.

Figure 5B:
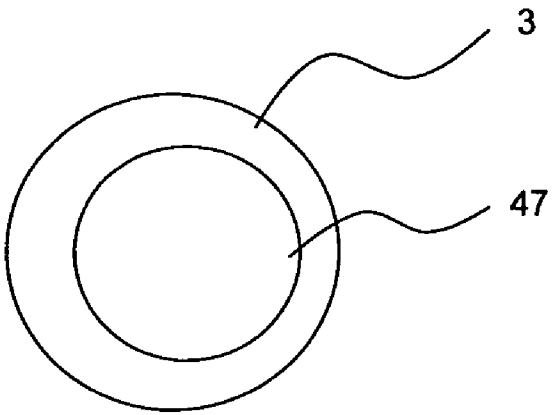
FIGS. 5A and 5B are explanatory views showing a photoconductor drum 3 in the image forming apparatus shown in FIG. 3 and a drive mechanism of a photoconductor drive motor 45 for driving the photoconductor drum 3.
Figure 5A:
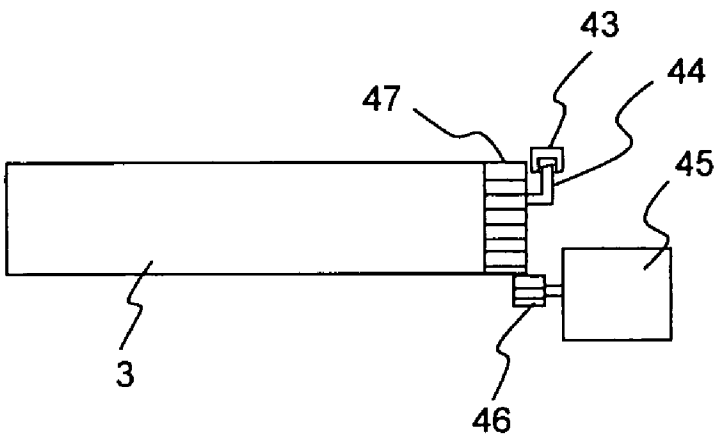

FIGS. 5A and 5B are explanatory views showing a drive mechanism of the photoconductor drum 3 and a photoconductor drive motor 45 for driving the same. FIG. 5A is a side view of the photoconductor drum 3 and the photoconductor drive motor 45 seen from the direction orthogonal to the rotational axis of the photoconductor drum 3. At one end of the photoconductor drum 3, a flange attached to the photoconductor drum 3 is provided, and a driven gear 47 is provided integrally with the flange.

Each photoconductor drum 3 is driven by the photoconductor drive motor 45 provided to correspond to each photoconductor drum 3. The rotation of the drive motor 45 is controlled by the control section. A drive gear 46 is fitted to the output axis of the photoconductor drive motor 45. The drive gear 46 is engaged with the driven gear 47. It is considered from the result of the analysis of the periodic fluctuation component of the color misregistration that the color misregistration is greatly caused by the eccentricity of the photoconductor drum 3 and the driven gear 47. FIG. 5B is an explanatory view conceptually showing the state of the eccentricity of the photoconductor drum 3 and the driven gear 47.

Even if the color misregistration is for the most part caused by the eccentricity of the photoconductor drum 3 and the driven gear 47, there are other causes. It has been known that another main cause is the eccentricity of the transfer belt drive roller 8-1 and the eccentricity of the photoconductor having a different diameter. This is acquired by the analysis of the periodic fluctuation component of the color misregistration. The photoconductor having a different diameter means the photoconductor for black, when a yellow image is the subject, for example. Alternatively, the photoconductor having a different diameter means the photoconductor for Y, M and C, when a black image is the subject.

When the toner pattern is formed and measured, the other causes become disturbances to deteriorate the precision of the measurement. Therefore, in the image forming apparatus according to the present invention, a plurality of toner patterns are formed to prevent the disturbances. However, it takes much time for the measurement only by forming many toner patterns to average the disturbances. Therefore, the interval between the toner patterns is set such that the periodic fluctuations of the other main disturbance factors cancel with each other. Specifically, the interval between the first toner pattern and the second toner pattern is set such that the phase of the disturbance is reversed in the first toner pattern and the second toner pattern.

The misregistration amount obtained from the first toner pattern and the misregistration amount obtained from the second toner pattern are calculated, whereby the misregistration amount in which the disturbance is suppressed is obtained. The phase of the fluctuation component with the predetermined cycle is obtained from the obtained misregistration amount.

The interval between the toner patterns is, for example, the distance between the front ends thereof, or the distance between the rear ends thereof. Specifically, the interval between the toner patterns is the distance between the corresponding portions of the adjacent toner patterns.

The control section obtains the rotational phase of the photoconductor drum 3 upon forming the toner pattern in each color by performing the aforesaid measurement for each color. The eccentricity of the photoconductor drum 3 is a very small amount that cannot be observed only by the visual observation of the rotating photoconductor drum 3. The phase of the eccentricity is obtained only after the toner pattern is formed and measured.

Figure 1:
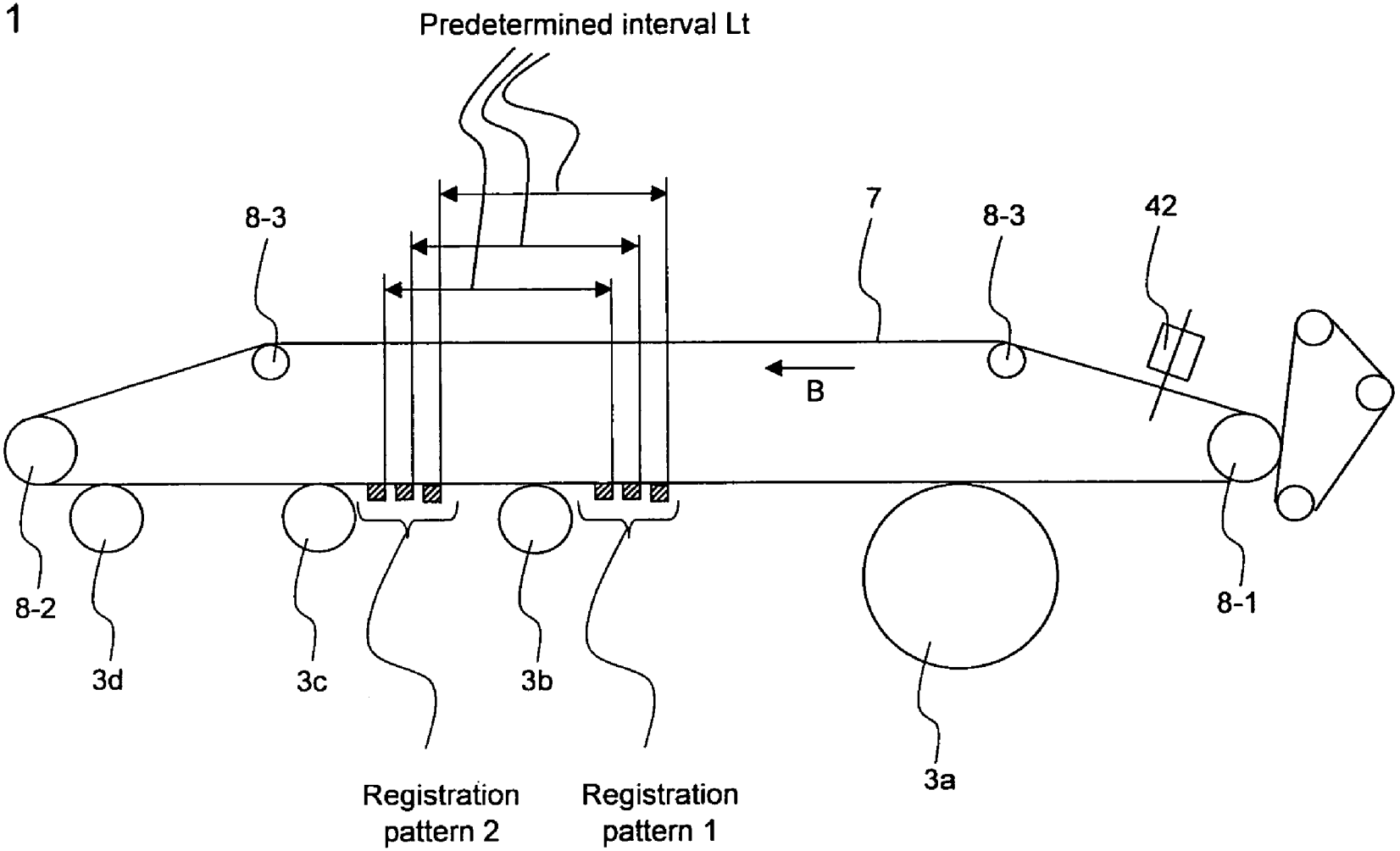
FIG. 1 is an explanatory view showing a state in which, in a color registration according to the present invention, a plurality of color registration toner patterns are formed at a predetermined interval for one color and are measured by a color registration sensor 42.

FIG. 1 is an explanatory view corresponding to FIG. 3, and shows the state in which, for one color, a plurality of toner patterns are formed with a predetermined interval Lt and measured by the color registration sensor 42. Each toner pattern is made of seventeen straight lines as shown in FIG. 4A.

For example, when the phase of the periodic fluctuation component of K is obtained, the interval Lt of each toner pattern of K may be set to 750 mm in order to remove the periodic fluctuation component of the transfer belt drive roller 8-1 included in the toner pattern of K. The interval Lt of the toner pattern generally corresponds to the integral multiple of the peripheral length of the K photoconductor drum 3*a* that forms the toner pattern of K, and the sum of the integral multiple of the peripheral length of the transfer belt drive roller 8-1 and the half rotation thereof. Specifically, Peripheral length of K photoconductor drum that is the subject of the measurement: 80 (mm)×π≅251 (mm)

Peripheral length of transfer belt drive roller that is the disturbance: 31.8 (mm)×π≅100 (mm)

Interval *Lt* of toner patterns: 750 (mm)=100 (mm)×7.5≅251 (mm)×3

The interval Lt is set to the sum of the integral multiple of the peripheral length of the transfer belt drive roller that is the disturbance and the half rotation thereof. Specifically, it is set such that the disturbance agreeing with the rotational cycle of the drive roller takes the reverse phase. Accordingly, if the misregistration amount is composed in each corresponding straight line of two toner patterns, the disturbance components of the cycle are canceled with each other. The misregistration amount is a numerical value with a sign, so that composing the misregistration amounts means that the addition of the numerical values with signs is performed.

The interval Lt of each toner pattern of K may be set to 1131 mm in order to remove the periodic fluctuation component of each of the Y, M and C photoconductor drums 3*d*, 3*c*, and 3*b* included in the toner pattern of K. The interval Lt of the toner pattern generally corresponds to the sum of the integral multiple of the peripheral length of the K photoconductor drum 3*a* that forms the toner pattern of K and its half rotation, and the sum of the integral multiple of the peripheral length of each of Y, M, and C photoconductor drums 3*d*, 3*c*, and 3*b*. Specifically, Peripheral length of K photoconductor drum that is the subject of the measurement: 80 (mm)×π≅251 (mm)

Peripheral length of each of Y, M, and C photoconductor drums that is the disturbance: 30 (mm)×π≅94.2 (mm)

Interval *Lt* of toner patterns: 1131 (mm)=94.2 (mm)×12≅251 (mm)×4.5

The interval Lt is set to the integral multiple of the peripheral length of each of the Y, M, and C photoconductor drums that is the disturbance. Specifically, it is set such that the disturbance agreeing with the rotational cycle of the photoconductor drum takes the same phase. Accordingly, if the difference between the misregistration amounts of each straight line corresponding to two toner patterns is calculated, the disturbance components of the cycle are canceled with each other. The misregistration amount is a numerical value with a sign, so that the calculation of the difference means that the subtraction of the numerical values with signs is performed.

As described above, the interval Lt of the toner patterns is within a range substantially equal to the integral multiple of the peripheral length of the photoconductor drum, which is the subject to be measured, or to the total sum of the integral multiple of the peripheral length and the half rotation, and may be within the range substantially equal to the total sum of the integral multiple of the peripheral length of the photoconductor drum having a diameter different from that of the photoconductor that is the subject to be measured and the half rotation, or to the integral multiple thereof.

The aforesaid substantially equal range may be the length corresponding to ±15° with respect to the phase angle in which one cycle of the periodic disturbance is 360°. Specifically, the aforesaid substantially equal range may be the range corresponding to the length of an arc of a sector having a central angle of ±15° in the transfer belt drive roller that is the disturbance, or the photoconductor drum that is the disturbance. According to the experience of the present inventor, the influence due to the periodic disturbance caused by the error in the processing precision corresponds to approximately four pixels in the misregistration amount shown in FIG. 4B. It is preferable that the misregistration amount due to the periodic disturbance is limited within one pixel. Specifically, it is preferable that the misregistration amount due to the disturbance is suppressed to about 25% of the original state. About 25% of the maximum misregistration amounts $d_{max+}$ and $d_{max-}$ correspond to a phase angle of ±15° from the reference phase in FIG. 4B. FIG. 4B shows the misregistration amount caused by the eccentricity of the photoconductor drum that is the subject to be measured, not showing the misregistration amount due to the disturbance. However, as for the periodic disturbance, it can be said that the misregistration amount due to the disturbance is suppressed to 25% in the vicinity of the phase angle of ±15° of the disturbance from the reference phase. Simply speaking, if the interval Lt of the corresponding patterns, i.e., the misregistration from the interval Lt of one set of patterns that is the subject of the addition or subtraction of the eccentricity, is within the range of the phase angle of ±15° of the periodic disturbance that should be suppressed, a preferable result can be obtained in which the influence of the disturbance is suppressed.

More preferable value of the aforesaid range is ±15.7° of the phase angle with one cycle of the periodic disturbance defined as 360°. According to the experience of the present inventor, more preferable result could be obtained, when the interval Lt of the toner patterns was set to 750 mm with respect to 753.98 mm that is the length three times the peripheral length of the K photoconductor drum having a diameter of 80 mm. In this case, the angle corresponding to 3.98 mm, which is the difference between 753.98 mm and 750 mm, is 5.7°. Therefore, more preferable result can be obtained within the range of the phase angle of ±5.7° with one cycle of the periodic disturbance defined as 360°.

Next, the case where the phase corresponding to the periodic fluctuation component of Y, for example, will be explained. In this case, the color misregistration is relatively adjusted by the rotational phase adjustment for the M and C photoconductor drums having the diameter same as that of the Y photoconductor drum, so that they do not become the disturbance. However, even if the rotational phase is adjusted for the K photoconductor drum, the effect of reducing the color misregistration cannot be obtained, since the K photoconductor drum has the different diameter. Specifically, the periodic component of the deviation corresponding to the peripheral length of the K photoconductor drum 3*a* becomes the disturbance. The interval Lt of the toner patterns in this case generally corresponds to the integral multiple of the peripheral length of the Y photoconductor drum 3*d*, and to the sum of the integral multiple of the peripheral length of the K photoconductor drum 3*a* and its half rotation. Specifically, Peripheral length of Y photoconductor drum 3*d* that is the subject to be measured: 30 (mm)×π≅94.2 (mm)

Peripheral length of K photoconductor drum 3*a* that is the disturbance: 80 (mm)×π≅251 (mm)

The interval Lt of toner patterns may be, for example, such that:

377 (mm)≅94.2 (mm)×4≅251 (mm)×1.5 or 1131 (mm)≅94.2 (mm)×12≅251 (mm)×4.5.

(Procedure 3 of Color Registration—Adjustment of Rotational Phase of Photoconductor Drum)

Even if the absolute value of the eccentric amount is constant, the color misregistration can be made unnoticeable by matching the phase of each color. FIG. 4C shows this concept. The misregistration amounts of the toner pattern of C (C pattern) and the toner pattern of Y (Y pattern) with respect to the reference position are equal to each other. However, if the phases of both of them are matched, the relative misregistration amount between each color is reduced. It has experientially been known that the human eye is sensitive more to the misregistration between each color than to the fluctuation of the absolute amount of the pixel pitch. Therefore, the color misregistration is dramatically improved by matching the phase of the eccentricity of each photoconductor, supposing that the eccentric amount of the photoconductor 3 is fixed.

As shown in FIG. 5A, a phase sensor 43 for producing a reference signal to control the rotational phase is disposed to correspond to each photoconductor drum 3. A projection 44 is provided at the side of the photoconductor drum 3. The phase sensor 43 outputs the reference signal every time the projection 44 passes its detection portion by one rotation of the photoconductor drum 3. A photointerrupter can be used for the phase sensor 43, for example. Each of the reference signals is inputted to the input circuit of the control substrate 40. The control section controls the drive of the drive motor 45 of each photoconductor so as to rotate each photoconductor in such a manner that the phase of each photoconductor is matched by using the inputted reference signal and the composite phase obtained by the aforesaid measurement.

Figure 6:
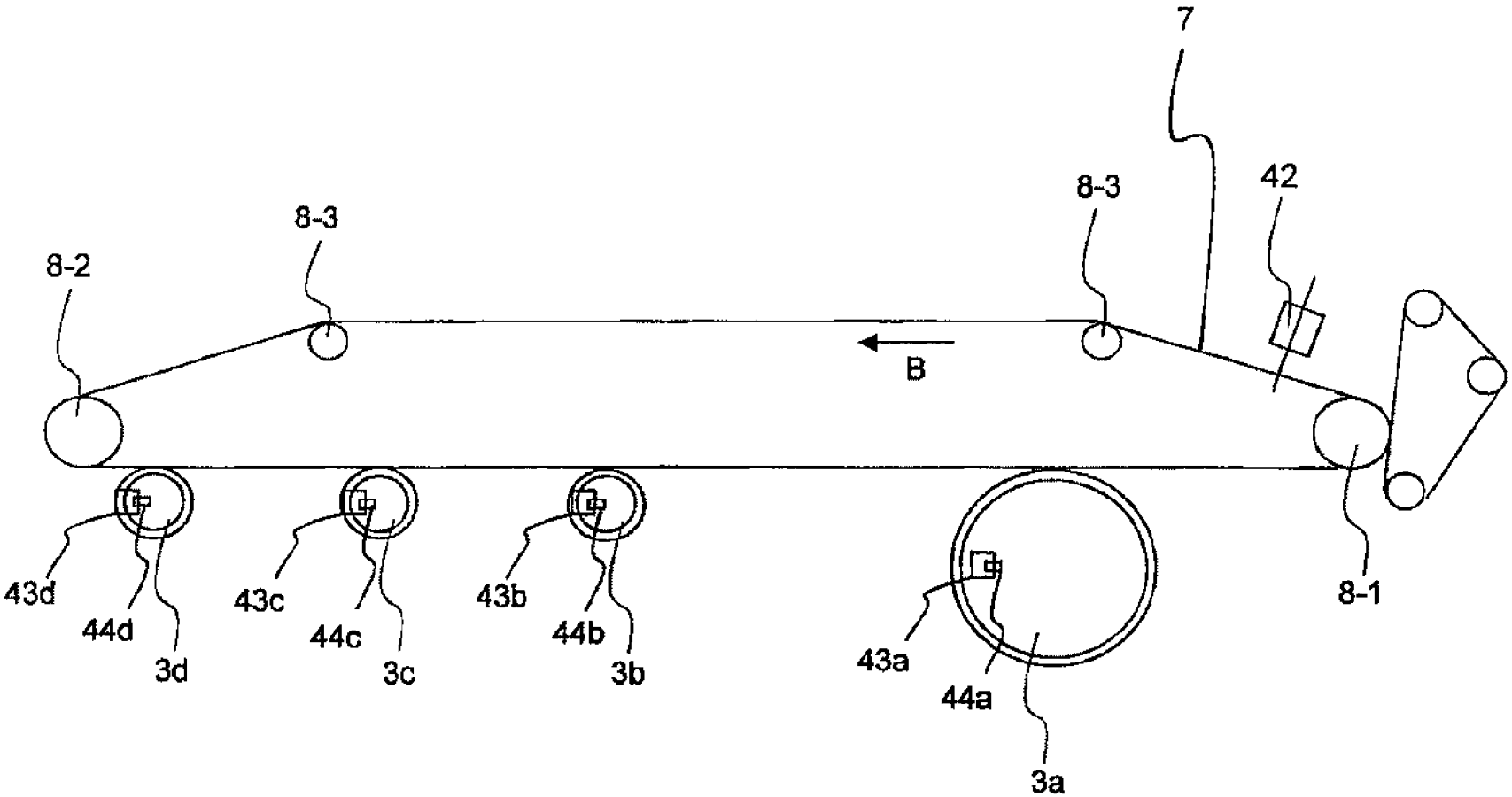
FIG. 6 is an explanatory view showing the state in which projections 44 and phase sensors 43 are provided to correspond to each photoconductor drum 3 shown in FIG. 3.

FIG. 6 is an explanatory view corresponding to FIG. 3. It shows the state in which the projection 44 and the phase sensor 43 are provided to correspond to each photoconductor drum 3. The control section determines the absolute rotational position (rotational phase) of each photoconductor from the reference signal outputted from each phase sensor.

It should be noted that the position of the projection 44 for each photoconductor drum is determined regardless of the direction of the eccentricity. This is because the eccentricity is produced due to the error in the precision in processing components or assembling precision, and the eccentricity is not provided intentionally. However, as described above, the relationship between the direction of the eccentricity and the projection 44 can be obtained by measuring the toner pattern to obtain the phase of the main fluctuation component.

Figure 7:
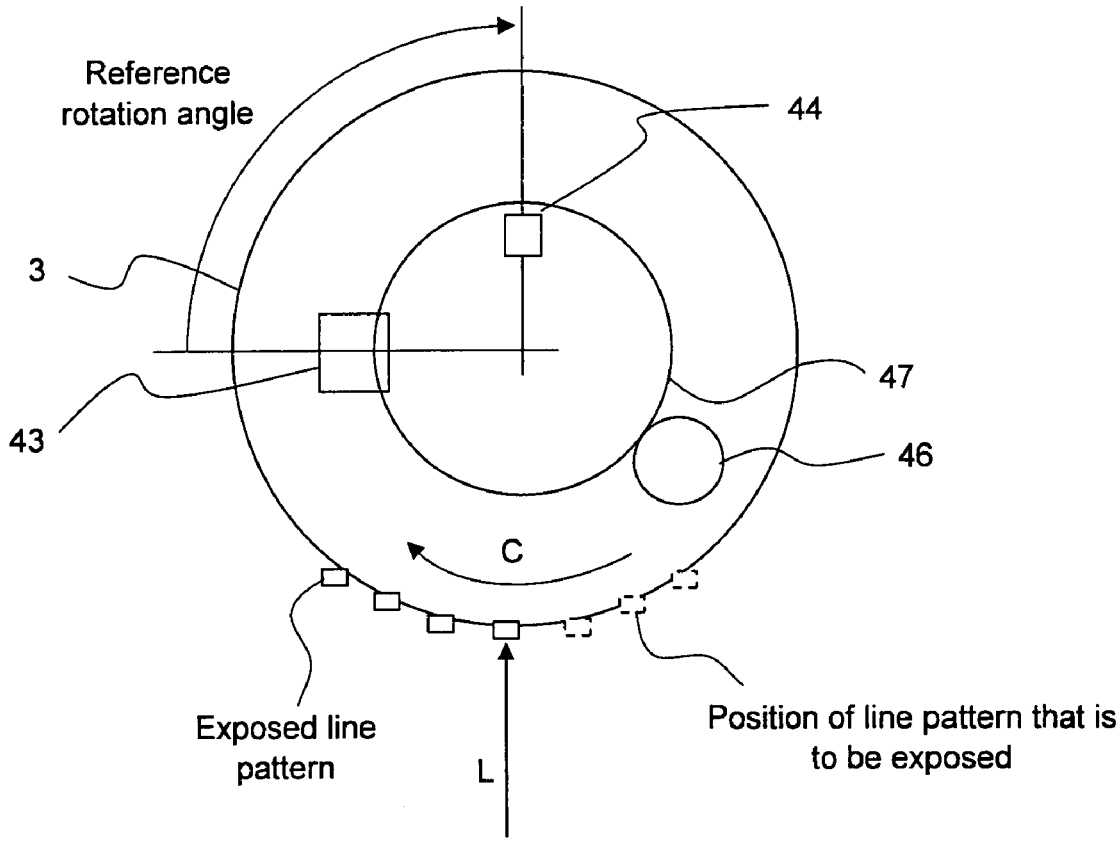
FIG. 7 is an explanatory view showing the state in which the toner pattern is formed on the photoconductor drum 3 shown in FIG. 3.

FIG. 7 is an explanatory view showing the state in which the toner pattern is formed on the photoconductor drum 3. The electrostatic latent image is formed at the position of the photoconductor drum 3 where the laser beam L scans to expose the photoconductor. The angle made by the line, linking the exposure position and the rotational axis, with respect to the eccentric direction, corresponds to the reference phase obtained by measuring the formed toner pattern. It is supposed here that, in FIG. 7, the position of the photoconductor drum 3 that is exposed at that moment is the reference phase obtained by the later-performed measurement. In this case, the angle made by the projection 44 and the phase sensor 43 is referred to as a "reference rotation angle". The rotation angle of the photoconductor drum 3 is an angle after the projection 44 passes the phase sensor 43. The reference rotation angle corresponds to the rotation angle from the time when the phase sensor 43 outputs the reference signal immediately before to the time when the toner pattern, which is the reference phase, is exposed.

FIGS. 12A and 12B are explanatory views, relating to FIG. 7, for explaining the relationship between the reference rotation angle and the reference phase. In FIGS. 12A and 12B, the lateral direction represents the lapse of time. As shown in FIG. 12A, the projection 44 passes the phase sensor 43, and the reference signal is outputted, at a time t1. Thereafter, at a time t2, the position that is the reference phase is exposed, and the electrostatic latent image of the registration toner pattern is formed at this position. The electrostatic latent image at the portion corresponding to the reference phase is developed with the rotation of the photoconductor drum 3, whereby a toner image is formed. Then, the toner image reaches the transfer position. The toner image is transferred to the intermediate transfer belt 7 at the transfer position. The transferred toner image is read by the color registration sensor 42 at a time t3. The control section obtains the reference phase from the misregistration amount of the read toner pattern as described above. The pattern read by the color registration sensor at the time t3 is consequently the position corresponding to the reference phase.

In the aforesaid manner, the control section determines the reference rotation angle of each photoconductor drum from the measured toner pattern.

Further, the control section adjusts the rotational phase of each of Y, M, and C photoconductor drums in order that the reference phases of the Y, M, and C photoconductor drums, each having the same diameter, match to one another.

The rotational phase may be adjusted, for example, by exposing the front end of the printed image with the reference rotation angle of each photoconductor drum. Alternatively, the rotational phase may be adjusted by exposing the front end of the image with a delay of a predetermined angle from the reference phase. It is to be noted that the delay amount is the same in Y, M and C. By virtue of this configuration, the phases of each of the formed images of Y, M and C match to one another, whereby the color misregistration is unnoticeable.

The control section executes the adjustment of the rotational phase of each photoconductor drum at the time when it stops each photoconductor drum after the formation of the toner pattern, for example. The control section controls the rotation of the drive motor 45 of each photoconductor such that, upon stopping, the rotation angle when each photoconductor drum 3 is stopped takes a predetermined relationship.

(Calculating Process of Interval between Toner Patterns and Misregistration Amount)

The interval between the toner patterns formed for each color is set to the predetermined interval Lt according to the aforesaid procedure. The predetermined interval Lt will further be explained. The setting of the interval Lt between the toner patterns has a degree of freedom described below. The control section can remove the disturbance component of the predetermined cycle by calculating the sum or difference of the misregistration amounts. When the disturbance component is removed by calculating the sum of the misregistration amounts, the interval Lt may be set to the integral multiple of the fluctuation period of the subject to be measured and the sum of the integral multiple of the fluctuation period of the disturbance and its half rotation. On the other hand, when the disturbance component is removed by calculating the difference of the misregistration amounts, the interval Lt may be the sum of the integral multiple of the fluctuation period of the subject to be measured and its half rotation, and the integral multiple of the fluctuation period of the disturbance. A designer may select which interval is used.

Figure 8:
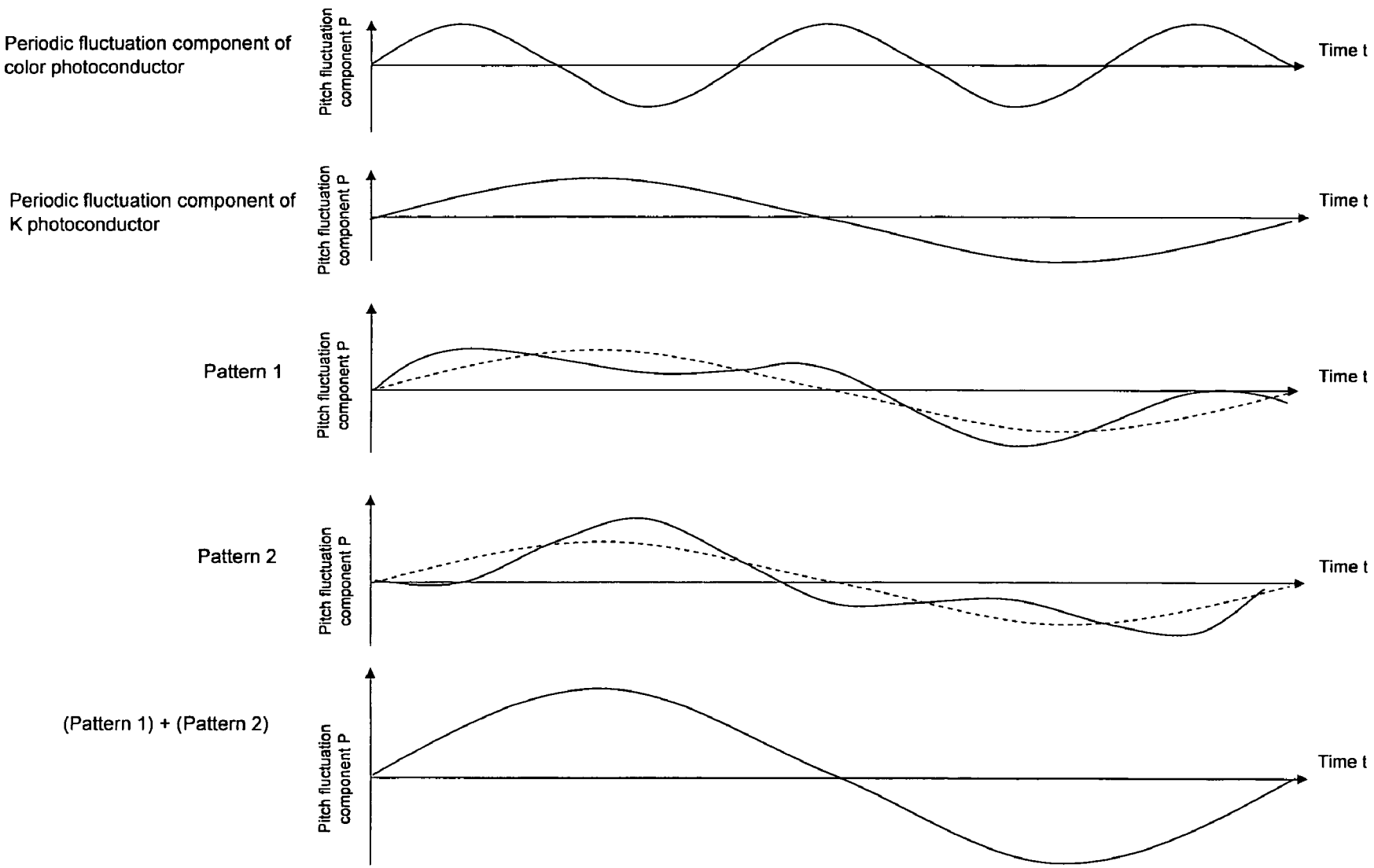
FIG. 8 is an explanatory view showing the case of calculating the sum of misregistration amounts in the color registration according to the present invention.

FIG. 8 is an explanatory view showing the case in which the disturbance component is removed by calculating the sum of the misregistration amounts. In FIG. 8, the fluctuation component corresponding to the rotational cycle of each of Y, M, and C photoconductor drums (color photoconductor drums) is defined as the disturbance, when K is the subject to be measured. The measured misregistration amount is a waveform from which the periodic component of the rotational cycle of the K photoconductor drum 3*a* and the periodic components of the rotational cycles of the color photoconductor drums are calculated.

Two patterns, i.e., a pattern 1 and a pattern 2, are formed as the toner pattern. In this case, the control section sets the pattern 1 and the pattern 2 to have a relationship shown in the figure. The fluctuation component corresponding to the K photoconductor drum 3*a* is the same phase, while the fluctuation component corresponding to the color photoconductor drums is the reverse phase. The control section calculates the sum of each deviation. This suppresses the disturbance component of the reverse phase and amplifies the fluctuation component corresponding to the K photoconductor drum 3*a* that is the subject to be measured.

Figure 9:
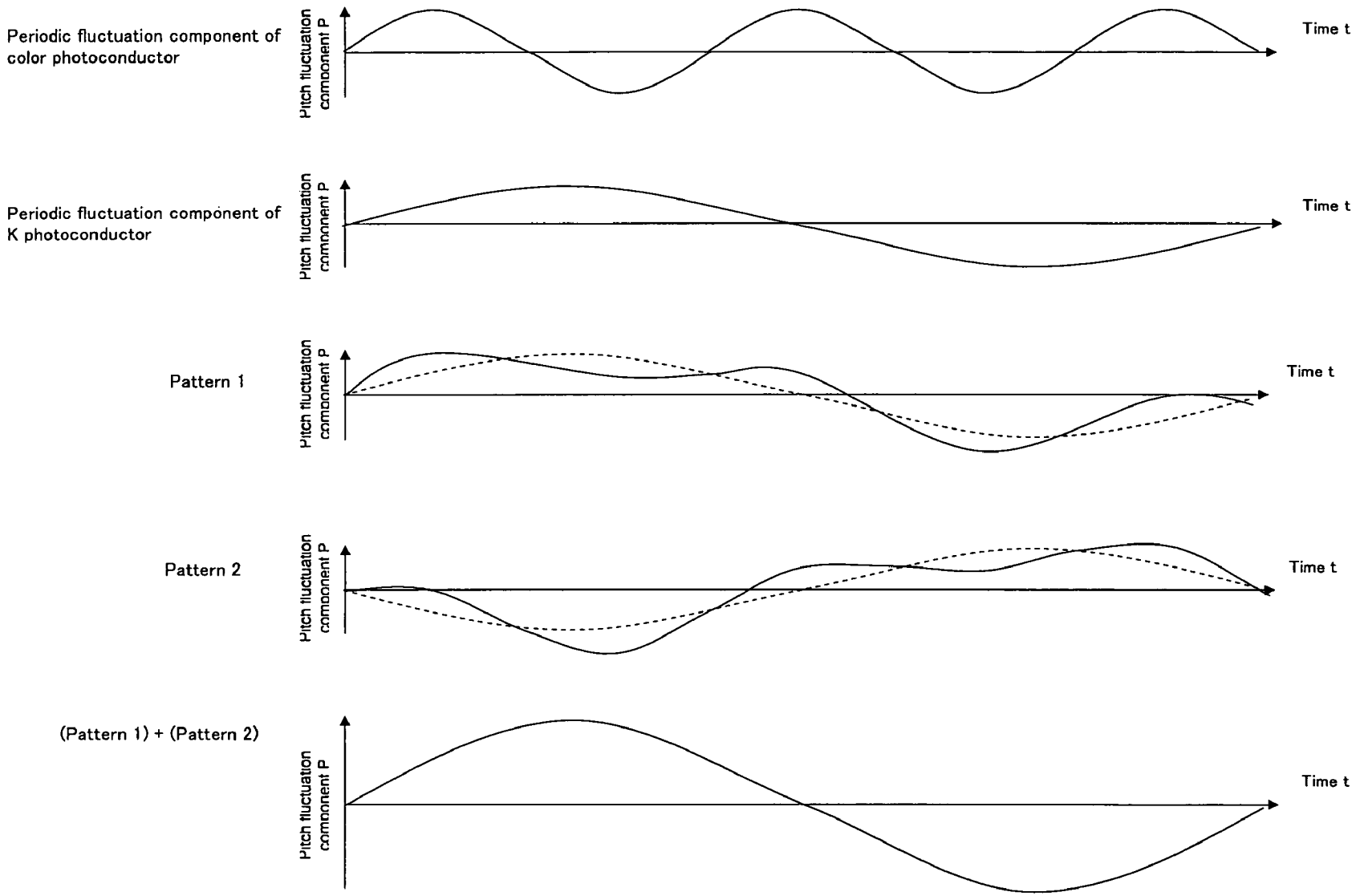
FIG. 9 is an explanatory view showing the case of calculating the difference between misregistration amounts in the color registration according to the present invention.

On the other hand, FIG. 9 is an explanatory view showing the case in which the disturbance component is removed by calculating the difference between the misregistration amounts. Like in FIG. 8, K is the subject to be measured, and the fluctuation component corresponding to the rotational cycles of the color photoconductor drums are defined as the disturbances.

Two patterns, i.e., a pattern 1 and a pattern 2, are formed as the toner pattern. In this case, the control section sets the pattern 1 and the pattern 2 to have a relationship shown in the figure. The fluctuation component corresponding to the K photoconductor drum 3*a* is the reverse phase, while the fluctuation component corresponding to the color photoconductor drums is the same phase. The control section calculates the difference of each deviation. This suppresses the disturbance component of the reverse phase and amplifies the fluctuation component corresponding to the K photoconductor drum 3*a* that is the subject to be measured.

(Suppression of Disturbance Component having Composite Cycle)

In FIGS. 8 and 9, the disturbance has a single periodic component. However, the present invention is applicable to the disturbance including a composite cycle.

The disturbance including the composite cycle means the following. When Y is the subject to be measured, the color misregistration is relatively adjusted by the rotational phase adjustment of the M and C photoconductor drums having the diameter same as that of the Y photoconductor drum, whereby M and C photoconductor drums do not become the disturbance. However, since the K photoconductor drum has the different diameter, the effect of reducing the color misregistration cannot be obtained only by adjusting the rotational phase. Specifically, the periodic component of the deviation corresponding to the peripheral length of the K photoconductor drum 3*a* is the disturbance. Further, the periodic component of the deviation corresponding to the peripheral length of the intermediate transfer belt 7 is the disturbance. The deviation obtained by the measurement contains both periodic components.

Therefore, if the interval Lt between the toner patterns is set as described below, both of the periodic component of the deviation corresponding to the peripheral length of the K photoconductor drum 3*a* and the periodic component of the deviation corresponding to the intermediate transfer belt 7 can be suppressed. Since Y (color photoconductor drum) is the subject to be measured, the interval Lt is set to satisfy the all three conditions described below.

(1) Integral multiple of the peripheral length of color photoconductor drum (94.2 mm)

(2) Integral multiple of peripheral length of K photoconductor drum 3*a* (251 mm)+half rotation (3) Integral multiple of peripheral length of intermediate transfer drive roller 7 (100 mm)+half rotation For example, 5655 mm that generally satisfies the three conditions of:

(1) 94.2 (mm)×60

(2) 251 (mm)×22.5

(3) 100 (mm)×56.5 is set as the interval Lt. If the sum of the deviations of the corresponding portions of the pattern 1 and the pattern 2 is calculated, the disturbance component is suppressed, whereby the target fluctuation component can be precisely measured.

When K is the subject to be measured, the effect of reducing the color misregistration cannot be obtained only by adjusting the rotational phase, since the color photoconductor drums have the different diameters. Specifically, the periodic component of the deviation corresponding to the peripheral lengths of the color photoconductor drums is the disturbance. Further, the periodic component of the deviation corresponding to the peripheral length of the intermediate transfer belt 7 is the disturbance. The deviation obtained by the measurement contains both periodic components.

Therefore, if the interval Lt between the toner patterns is set as described below, both of the periodic component of the deviation corresponding to the peripheral length of the color photoconductor drums and the periodic component of the deviation corresponding to the intermediate transfer belt 7 can be suppressed. Since K photoconductor drum 3*a* is the subject to be measured, the interval Lt is set to satisfy the all three conditions described below.

(1) Integral multiple of the peripheral length of K photoconductor drum 3*a* (251 mm)+half rotation (2) Integral multiple of peripheral length of color photoconductor drum (94.2 mm)

(3) Integral multiple of peripheral length of intermediate transfer drive roller 7 (about 100 mm)

For example, 4901 mm that generally satisfies the three conditions of:

(1) 251 (mm)×19.5

(2) 94.2 (mm)×52

(3) 100 (mm)×49 is set as the interval Lt. If the difference of the deviations of the corresponding portions of the pattern 1 and the pattern 2 is calculated, the disturbance component is suppressed, whereby the target fluctuation component can be precisely measured.

Since the K photoconductor drum 3*a* has the different diameter as described above, the color misregistration cannot be reduced by matching the phase thereof to the phases of Y, M and C. Therefore, as for the K photoconductor drum 3*a*, the speed of the photoconductor drive motor 45*a* is periodically corrected to make the peripheral speed of the K photoconductor drum 3*a* constant on the basis of the reference signal that is the output from the K phase sensor 43*a* and the reference rotation angle of K. Thus, the pitch fluctuation component of K is suppressed, thereby reducing the color misregistration.

(Reduction in Color Misregistration by Correction of Drive Speed of Photoconductor)

As described above, the diameter of each of the color photoconductor drums and the diameter of the K photoconductor drum are different. The technique for suppressing the pitch fluctuation component of each image formed by the photoconductor drum having a different diameter will be explained hereinafter.

Figure 10:
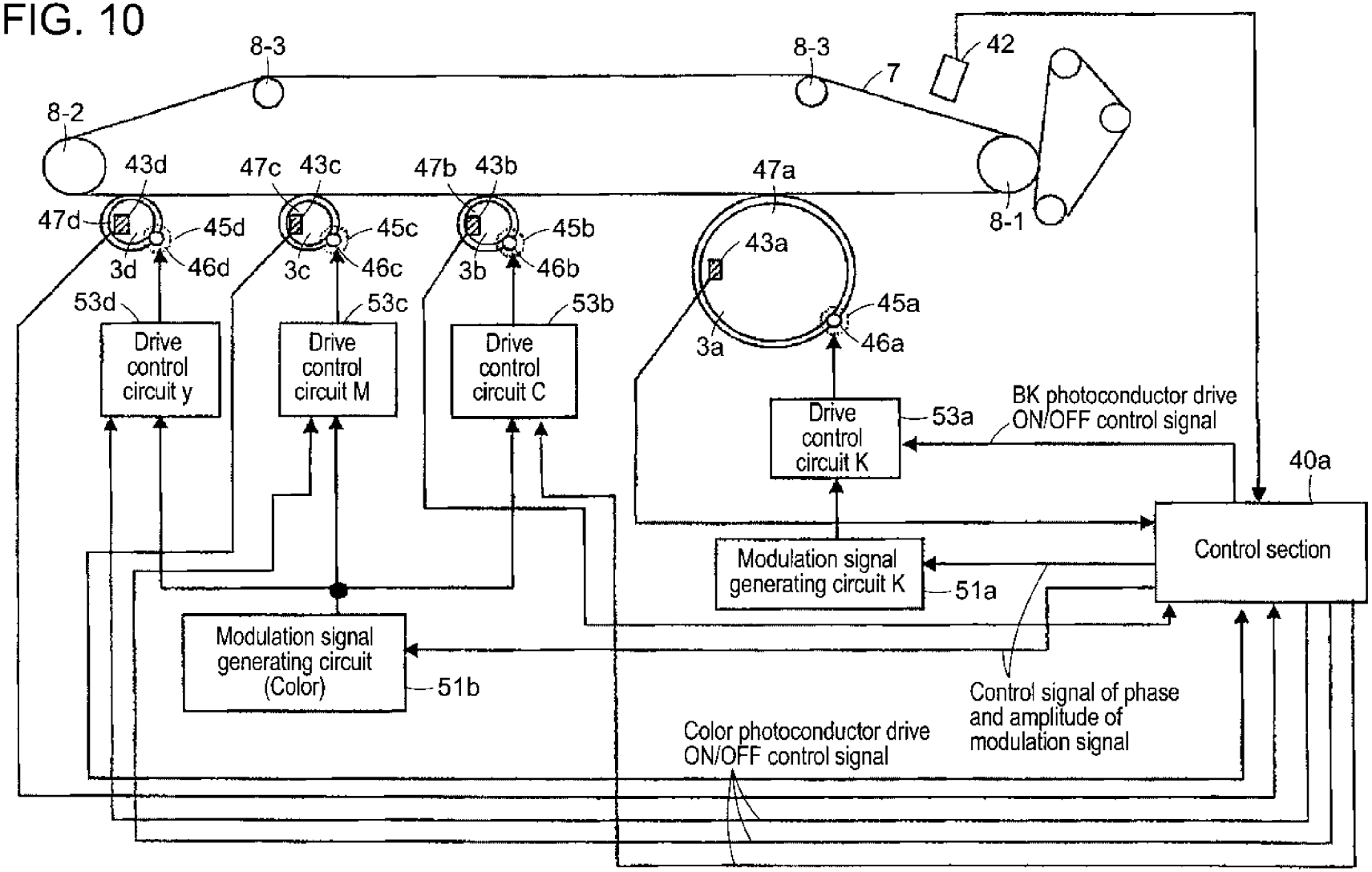
FIG. 10 is an explanatory view showing a block configuration of a control system relating to the color registration in the image forming apparatus according to the present invention.

FIG. 10 is an explanatory view showing a block configuration for correcting the pitch fluctuation component in this embodiment. The image forming apparatus corrects the drive speed of each photoconductor on the basis of the result of the measurement of the misregistration amount in order to suppress the effect by the eccentricity. As shown in FIG. 10, each photoconductor drive motor 45 is controlled by the corresponding drive control circuit 53. Each drive control circuit 53 drives each photoconductor drive motor 45 with a drive speed according to the diameter of each photoconductor. Further, a modulation signal from a modulation signal generating circuit 51 is inputted to the drive control circuit 53 for suppressing the speed variation corresponding to the rotational cycle of each photoconductor. Each of the drive control circuits 53 corresponds to a drive control section in the claims. Each of the modulation signal generating circuits 51 corresponds to a correction signal output section in the claims. Each of the modulation signals corresponds to a speed correction signal in the claims.

As shown in FIG. 10, the modulation signal generating circuit 51 is provided to correspond to the type of the diameter of the photoconductor drum 3. Specifically, a modulation signal generating circuit K51*a* is provided for the K photoconductor drum 3*a*, and a single modulation signal generating circuit (color) 51*b* is provided for the color photoconductor drums 3*b*, 3*c*, and 3*d*.

The cycle of the modulation signal of K matches to the rotational cycle Tk of the photoconductor K. The cycle of the modulation signal (for color) matches to the rotational cycle Tc of the color photoconductors.

The detection signals from the color registration sensor 42 and the phase sensor 43 corresponding to each photoconductor drum 3 are inputted to the control section 40*a*. The control signals for the drive control circuit 53 corresponding to each photoconductor drum 3 and each of the modulation signal generating circuits 51 of K and color are outputted from the control section 40*a*. It is to be noted that input/output signals not shown in FIG. 10 are connected to control the operation of each section of the image forming apparatus.

As for the color registration, the control section 40*a* outputs the control signals to each drive control circuit 53 for controlling the drive of each photoconductor drum 3. Then, the control section 40*a* forms a registration toner patch, transfers the same onto the intermediate transfer belt 7, and reads the position of each pattern by the color registration sensor 42.

The control section 40*a* calculates the misregistration amount (deviation) of the position of the read pattern from the reference position, and obtains the phase of the eccentricity (rotational phase) of each photoconductor drum 3 on the basis of the calculated deviation. Then, the control section 40*a* adjusts the relative position of each photoconductor drum 3 in such a manner that the obtained rotational phases are matched.

Further, the control section 40*a* obtains the amplitude of the eccentricity of each photoconductor drum 3 from the result of the measurement of the toner pattern, and controls the phase and amplitude of the modulation signal generated at the modulation signal generating circuits 51*a* and 51*b* according to the obtained phase and amplitude.

Figure 11:
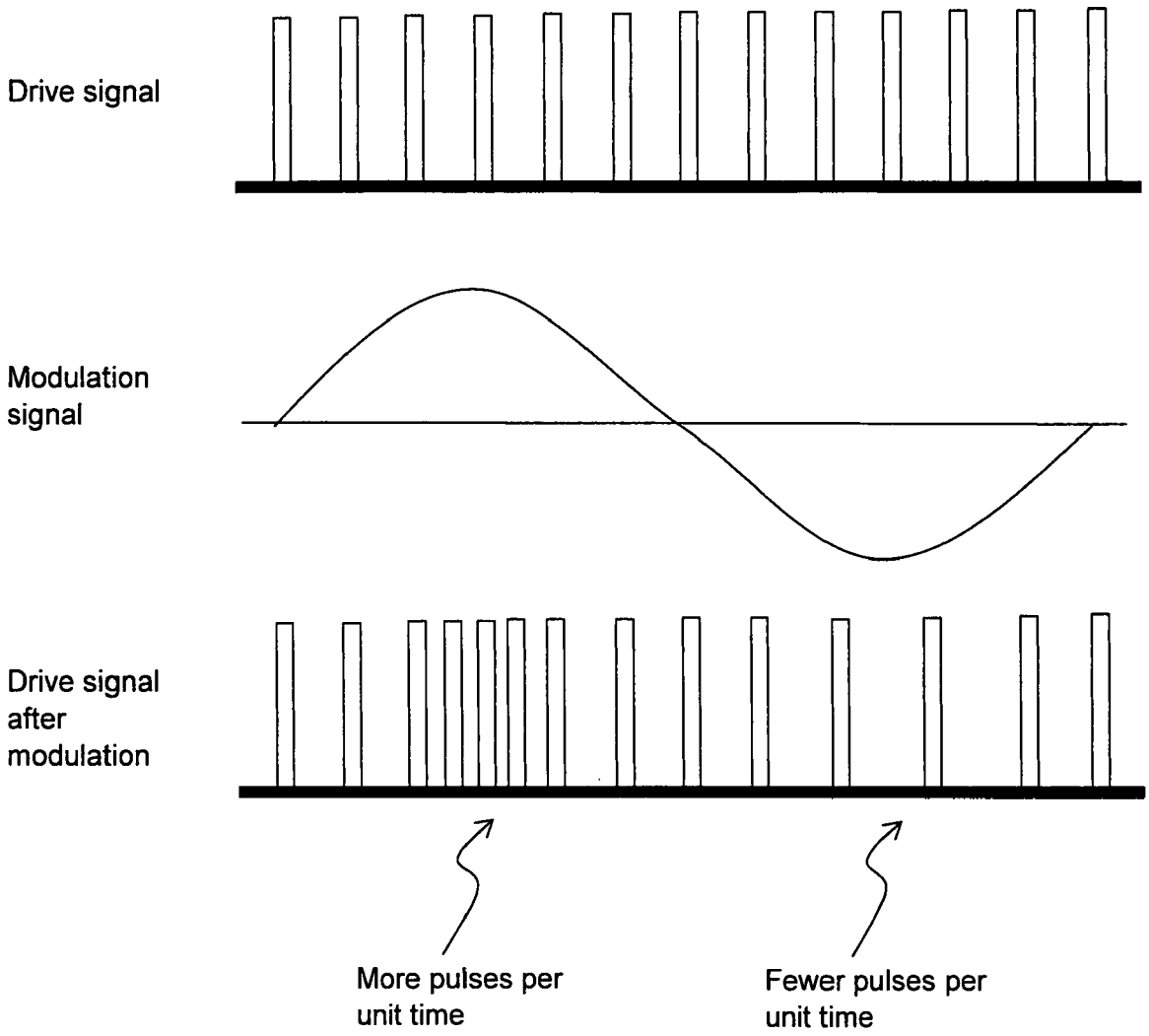
FIG. 11 is a waveform chart showing the state in which a drive control circuit 53 for correcting a pitch fluctuation component drives each photoconductor drive motor with the modulated drive signal in the image forming apparatus according to the present invention.

FIG. 11 is a waveform chart showing the state in which each of the drive control circuits 53 shown in FIG. 10 produces the drive signal by the modulation to the drive signal with a constant speed based upon the modulation signal, and each photoconductor drive motor 45 is driven by the generated drive signal. Each photoconductor drive motor 45 in FIG. 10 is a stepping motor. The drive signal has a waveform of a drive pulse corresponding to the phase switching of the stepping motor.

The modulated drive signal must have the phase and the amplitude for canceling the fluctuation of the peripheral speed due to the eccentricity. Each modulation signal generating circuit 51 is a block that generates the modulation signal satisfying the aforesaid condition. More specifically, each modulation signal generating circuit 51 is a sine wave generating circuit that can adjust the amplitude and the phase of the output signal.

(Adjustment of Rotational Phase of Photoconductor Drum)

After the color registration is performed, the control section stores $\Delta t = t2 - t1$ shown in FIGS. 12A and 12B. After that, the control section outputs a synchronous signal after the time $\Delta t$ from the reference signal outputted from the phase sensor. Therefore, the synchronous signal is a signal synchronous with the timing when the position that is the reference phase is exposed. The value of $\Delta t$ is independently stored for each photoconductor drum 3. The synchronous signal is a signal respectively outputted for each photoconductor drum 3.

In the manner described above, the control section determines the reference rotation angle of each photoconductor drum on the basis of the reference phase of the measured toner pattern.

Further, the control section adjusts the rotational phases of Y, M and C photoconductor drums such that each of the reference phases are matched from the misregistration amount of the measured toner pattern from the reference phase.

The rotational phase may be adjusted, for example, by exposing the front end of the printed image with the reference rotation angle of each photoconductor drum. Alternatively, the rotational phase may be adjusted by exposing the front end of the image with the delay of the predetermined angle from the reference phase. It is to be noted that the delay amount is the same in Y, M and C. By virtue of this configuration, the phases of each of the formed images of Y, M and C are matched, whereby the color misregistration is unnoticeable.

The control section executes the adjustment of the rotational phase of each photoconductor drum at the time when it stops each photoconductor drum after the formation of the toner pattern, for example. The control section controls the rotation of each photoconductor drive motor 45 such that, upon stopping, the rotation angle when each photoconductor drum 3 is stopped takes the predetermined relationship. Specifically, the control section controls the rotation angle of the photoconductor upon stopping in such a manner that the synchronous signals of Y, M and C have the predetermined phase relationship shown in FIG. 14.

Figure 14:
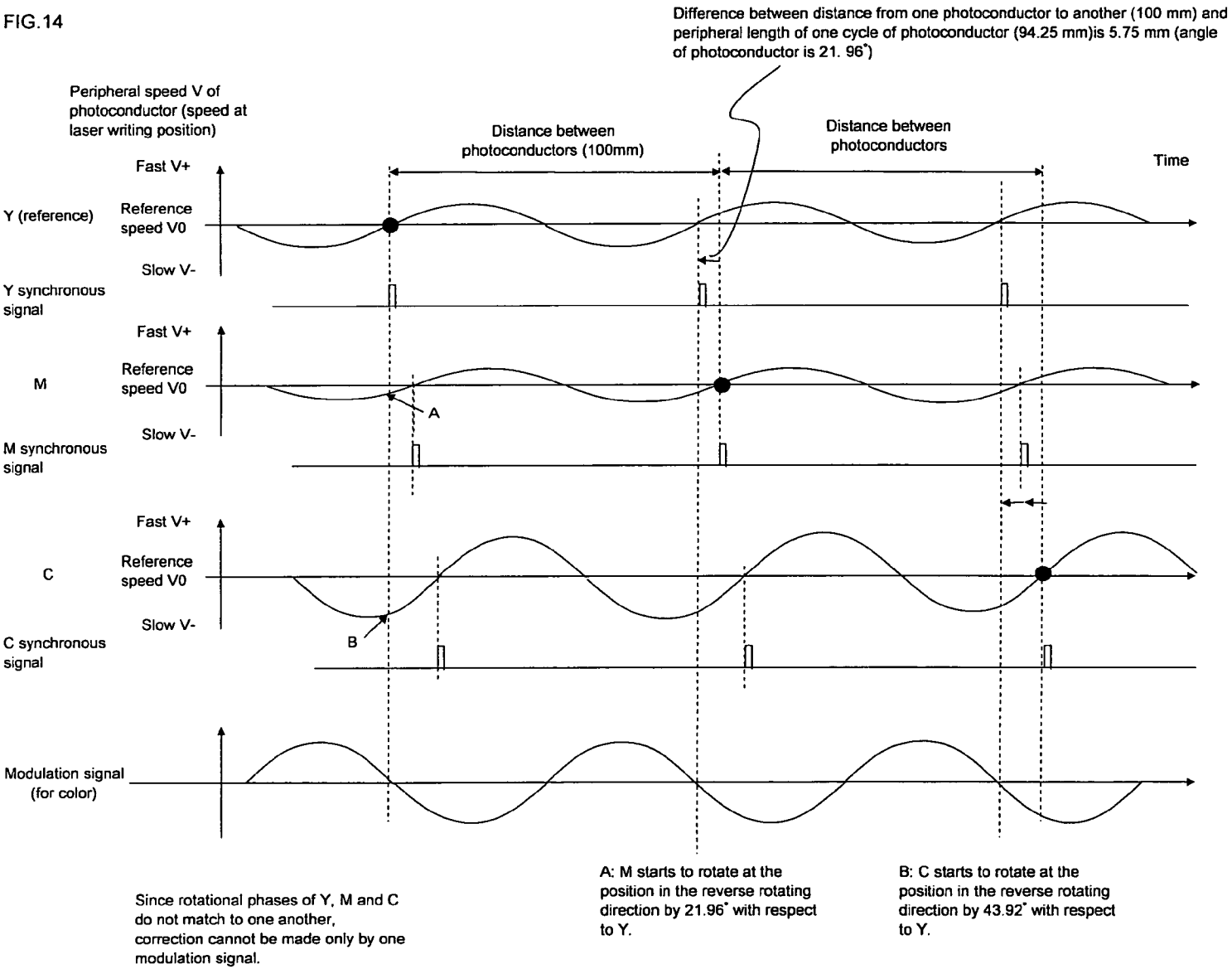
FIG. 14 is an explanatory view showing a peripheral speed fluctuation component of the photoconductor in the state in which the rotational phase of each photoconductor is adjusted in such a manner that the phases of the pitch fluctuation component match to each other on the image in the image forming apparatus according to the present invention.

FIG. 14 is an explanatory view showing the peripheral speed fluctuation component of each photoconductor in the state in which the rotational phase of each photoconductor is adjusted such that the phases of the peripheral speed fluctuation components of each photoconductor for each image (each color) match to each other on the printed sheet in this embodiment. A black circle in FIG. 14 indicates the position of each of Y, M and C images that should be transferred to the same position on the recording medium (print sheet). In this case, the reference phases of each of Y, M and C photoconductor drums 3 are deviated. The distance between the transfer position of the Y photoconductor drum 3*d* and the transfer position of the M photoconductor drum 3*c* is 100 mm. On the other hand, the peripheral length of the photoconductor 3 is 92.25 mm. Therefore, the deviation that is 5.75 mm in terms of distance and 21.96° in terms of rotation angle of the photoconductor is present between both of them. The same is true for the relationship between the M photoconductor drum 3*c* and the C photoconductor drum 3*b*, wherein the deviation that is 5.75 mm in terms of distance and 21.96° in terms of rotation angle of the photoconductor is present between both of them.

Accordingly, with the state in which the rotational phase is adjusted, the rotational phase of the M photoconductor drum 3*c* is delayed by 21.96° from the rotational phase of the Y photoconductor drum 3*d*. Similarly, the rotational phase of the C photoconductor drum 3*b* is delayed by 21.96° from the rotational phase of the M photoconductor drum 3*c*. Specifically, the rotational phase of the C photoconductor drum 3*b* is delayed by 43.92° from the rotational phase of the Y photoconductor drum 3*d*.

If the distance between each transfer position is agreed with the peripheral length of the photoconductor, the rotational phase of each photoconductor is matched to each other. However, this imposes a limitation on a layout interval around each photoconductor or the size of the image forming apparatus.

In view of this, when the distance between the transfer positions and the peripheral length of the photoconductor do not agree with each other, the phase of the color modulation signal is controlled with any one of Y, M, and C defined as a reference. In the embodiment shown in FIG. 14, Y is defined as the reference. In this case, the phase of the modulation signal (for color) is controlled on the basis of the Y synchronous signal outputted after Δt from the reference signal outputted from the Y phase sensor 43*d*. In the case of FIG. 14, the phase of the modulation signal (for color) is controlled such that the reference phase of the modulation signal (for color) is synchronized with the Y synchronous signal. Specifically, the phase of the modulation signal is controlled such that the modulation signal (for color) increasing in the negative direction from zero is outputted at the timing when the Y synchronous signal is outputted.

Figure 15:
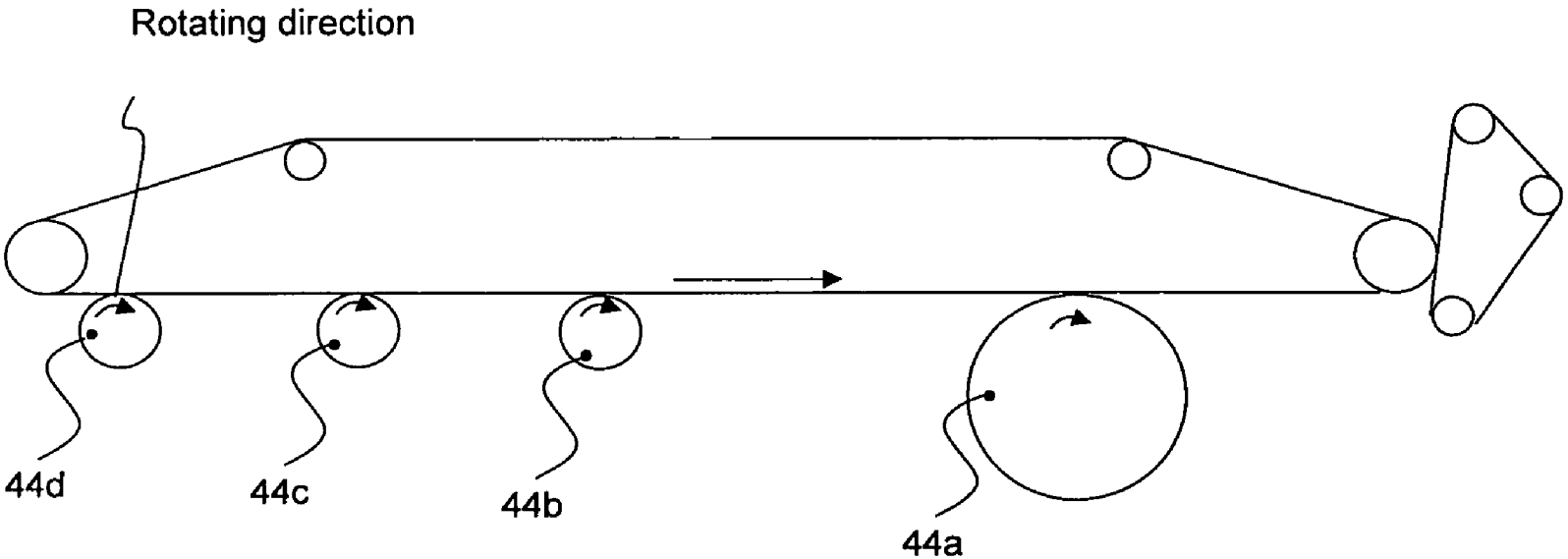
FIG. 15 is an explanatory view showing an example of the position of each projection 44 in the state in which the rotational phase of each photoconductor is adjusted in the image forming apparatus according to the present invention.

FIG. 15 is an explanatory view for showing an example of the position of each projection 44 in the present embodiment in the state in which the rotational phase of each photoconductor is adjusted. Since there is no correlation between the direction of each projection and the direction of the eccentricity of the photoconductor, the direction of the projection 44 of each photoconductor is random. FIG. 15 is for showing the correspondence to the later-described FIG. 18.

When the modulation signal from the modulation signal generating circuit 51*b* is inputted to each drive control circuit 51*b*, 51*c*, and 51*d* with the state in which the rotational phase of each of Y, M and C photoconductor drums 3 is adjusted, a deviation is produced between the peripheral speed fluctuation component of the photoconductor and the phase of the modulation signal.

For example, it is supposed that the amplitude of the peripheral speed fluctuation component of the C photoconductor drum 3*b* is the greatest, and the modulation signal generating circuit 51*b* generates the modulation signal having the phase reverse to that. In this case, the modulation signal is also inputted to the Y and M drive control circuits 51*d* and 51*c* from the modulation signal generating circuit 51*b*. As for the C photoconductor drum 3*b*, the phase is corrected, so that the peripheral speed fluctuation component is well suppressed, but the phase of the modulation signal to the peripheral speed fluctuation component is deviated for the Y and M photoconductor drums 3*d* and 3*c*.

Therefore, the control section corrects the rotational phase of each photoconductor from the state in which the rotational phase of each of Y, M and C photoconductor drums 3 is adjusted, in order that the phases of the pitch fluctuation component on the image match to each other. This makes it possible to match the rotational phase of each of Y, M and C photoconductors to one another and to reverse the phase of the peripheral speed fluctuation component of each photoconductor drum to the common modulation signal. Specifically, the rotational phase of the M photoconductor drum 3*c* is advanced in its rotating direction by 21.96°. Further, the rotational phase of the C photoconductor drum 3*b* is advanced in its rotating direction by 43.92°. Specifically, the rotational phase of the stopped photoconductors is controlled to match the M and C synchronous signals with the Y synchronous signal with the Y synchronous signal as a reference.

In this case, somewhat of a deviation occurs between the direction of the eccentricity of each of Y, M and C photoconductor drums 3 and the position of each image formed on the surface of the photoconductor drum, but the peripheral speed fluctuation component of each photoconductor is cancelled by using the modulation signal, whereby the absolute value of the color misregistration is reduced. Accordingly, the color misregistration becomes unnoticeable.

Figure 18:
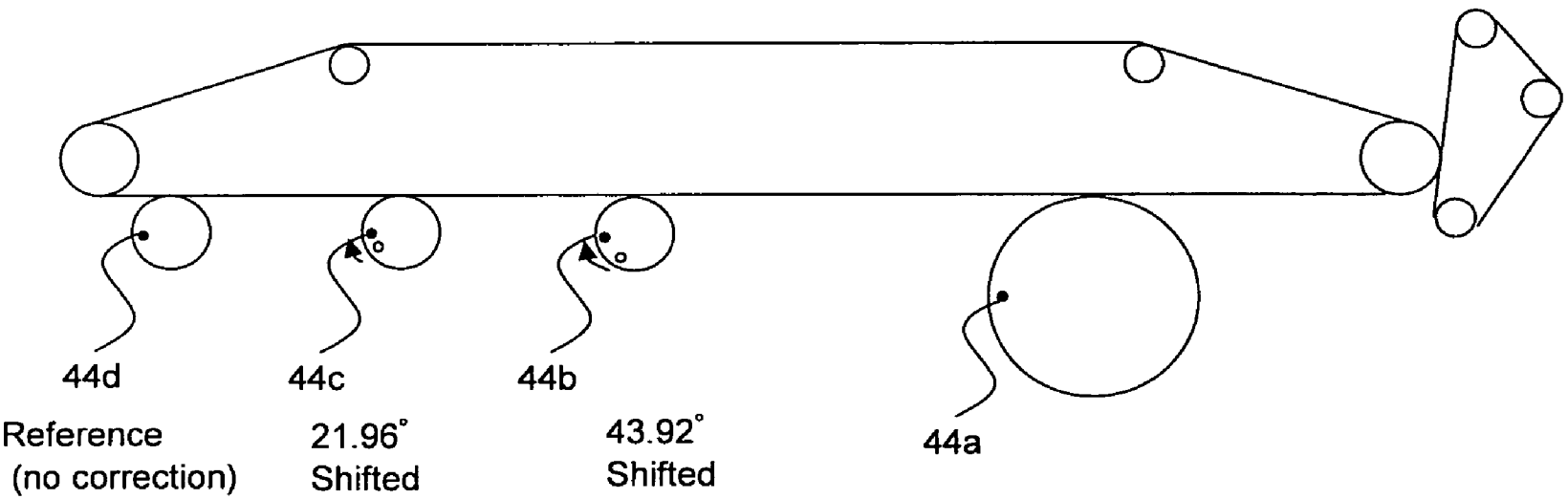
FIG. 18 is an explanatory view showing an example of the position of each projection 44 in the state in which the rotational phases of each photoconductor are matched to each other in the image forming apparatus according to the present invention.

FIG. 18 corresponds to FIG. 15. FIG. 18 is an explanatory view showing an example of the position of each projection 44 in the state in which the rotational phase of each photoconductor is adjusted. The adjustment amount of the rotational phases of the M photoconductor drum 3*c* and the C photoconductor drum 3*b* in FIG. 18 is the value obtained beforehand from the difference between the distance between the transfer positions of each photoconductor and the peripheral length.

The rotational phase of the color photoconductor drum can be obtained by measuring the registration toner pattern. In other words, it is not until the toner pattern is measured that the rotational phase of each photoconductor is found. However, the adjustment amount for matching the rotational phase of each photoconductor drum from the state where the phases of the pitch fluctuation component on the image match to each other is found beforehand. The control section adjusts the rotational phase of each photoconductor drum 3 after it matches the phase of the pitch fluctuation component on the image by the measurement of the toner pattern. In this manner, the adjustment amount of the rotational phase of each photoconductor drum 3 is derived in two stages. It is to be noted that the process for physically deviating the rotational phase of each photoconductor drum may be executed at one time at the stage where the final adjustment amount is derived.

FIG. 16 is an explanatory view showing the state of the peripheral speed fluctuation component of each photoconductor in the state in which the rotational phases of each photoconductor drum 3 match to each other. With this state, the modulation signal generating circuit 51*b* generates the modulation signal having a reverse phase to each of Y, M and C photoconductor drums 3*d*, 3*c* and 3*b*. Each of Y, M and C drive control circuits 53*d*, 53*c* and 53*b* corrects the drive speed with the modulation signal. Thus, the peripheral speed fluctuation component of each photoconductor is corrected.

A black circle in FIG. 16 indicates the position of each of Y, M and C images that should be transferred onto the same position on the recording medium. Supposing that the position of the black circle is defined as the front end portion of the printed image, the position of the front end portion of the Y, M and C printed images matches to the synchronous signal in FIG. 14. On the other hand, with the state after the rotational phase is adjusted, the position of the front end portion of the Y printed image matches to the Y synchronous signal, but the position of the front end portion of the M printed image is delayed from the M synchronous signal by 21.96° and the front end portion of the C printed image is delayed from the C synchronous signal by 43.92° as shown in FIG. 16. The control section controls the exposure timing at the front end portion of each printed image for the synchronous signal one before the present synchronous signal as shown in FIG. 16.

Figure 17:
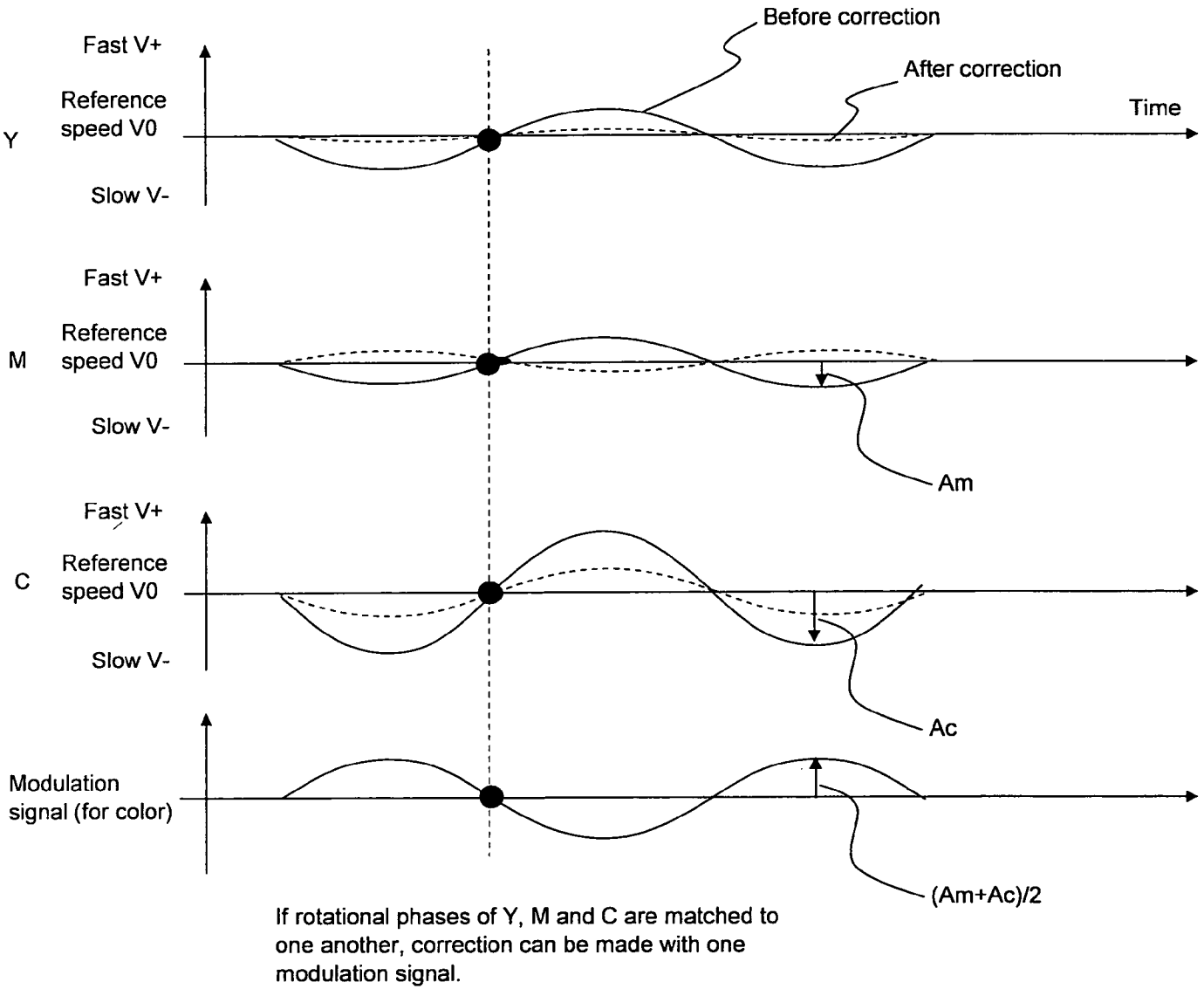
FIG. 17 is an explanatory view showing the state in which each drive control circuit 53 cancels the peripheral speed fluctuation component of the photoconductor by using a modulation signal in the image forming apparatus according to the present invention.

FIG. 17 is an explanatory view showing the state in which each drive control circuit 53 cancels the peripheral speed fluctuation component of each photoconductor by using the modulation signal in the present embodiment. In FIG. 17, a solid line indicates the speed fluctuation before the correction, while a chain line indicates the speed fluctuation after the correction.

The amplitude of each modulation signal is adjustable. The amplitude of the color modulation signal is adjusted such that the amplitude of the pitch fluctuation component included in the image in each color is detected, and the maximum amplitude and the minimum amplitude among the amplitudes obtained for the pitch fluctuation component of each of Y, M and C colors are selected. Then, the intermediate values of the maximum amplitude and the minimum amplitude are obtained. Next, the variation amount of the rotation speed of the photoconductor corresponding to the obtained amplitude (intermediate value) is obtained. If the diameter of the photoconductor and the reference rotation speed are determined beforehand, the variation amount of the rotation speed corresponding to the amplitude of the pitch fluctuation can be calculated by using them. The control section determines the amplitude of the modulation signal (for color) that cancels the obtained variation amount.

More specifically, it is supposed that the speed variation amplitude of the C photoconductor having the greatest variation amount of the rotation speed is defined as Ac, and the speed variation amplitude of the M photoconductor having the smallest variation amount of the rotation speed is defined as Am. In this case, the control section employs the intermediate value of Ac and Am, i.e., (Ac+Am)/2, as the amplitude of the modulation signal. The reason is as follows. If the amplitude of the modulation signal (for color) is determined to completely cancel the peripheral speed variation component of the photoconductor drum having the greatest amplitude, the correction amount becomes too great to the photoconductor drum having the smallest amplitude.

Figure 19:
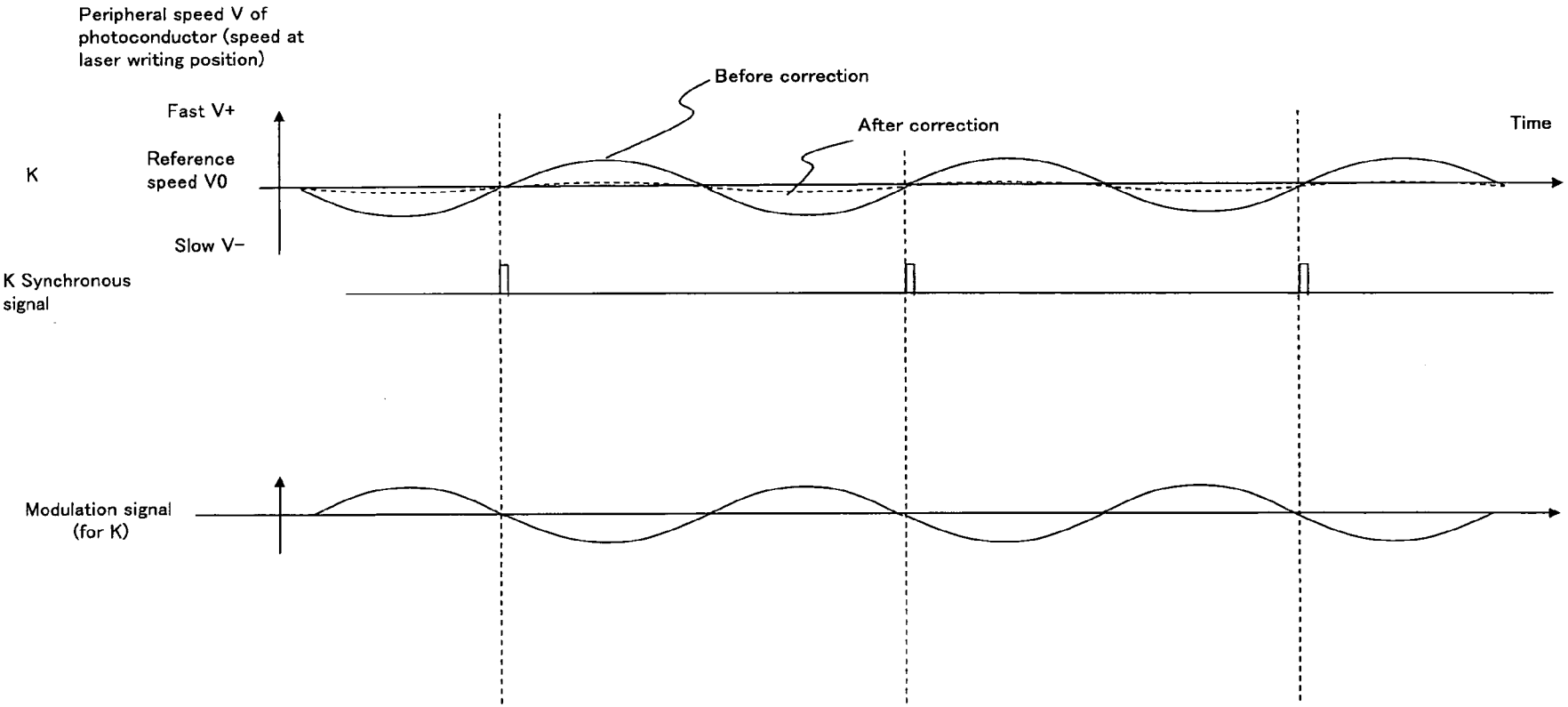
FIG. 19 is an explanatory view showing the state of the modulation signal for suppressing the peripheral speed fluctuation component of a K photoconductor in the image forming apparatus according to the present invention.

FIG. 19 is an explanatory view showing the state of the modulation signal for suppressing the peripheral speed fluctuation component of the K photoconductor. The modulation signal generating circuit 51*a* controls the phase of the modulation signal (for K) on the basis of the K synchronous signal outputted after Δt in FIG. 12 from the reference signal outputted from the K phase sensor 43*a*. In the case of FIG. 19, the phase of the modulation signal (for K) is controlled such that the reference phase of the modulation signal (for K) is synchronized with the K synchronous signal. Specifically, the phase of the modulation signal is controlled such that the modulation signal (for K) increasing from zero in the negative direction is outputted at the timing when the K synchronous signal is outputted.

(Formation of Registration Toner Pattern and Control of Measurement)

Figure 21:
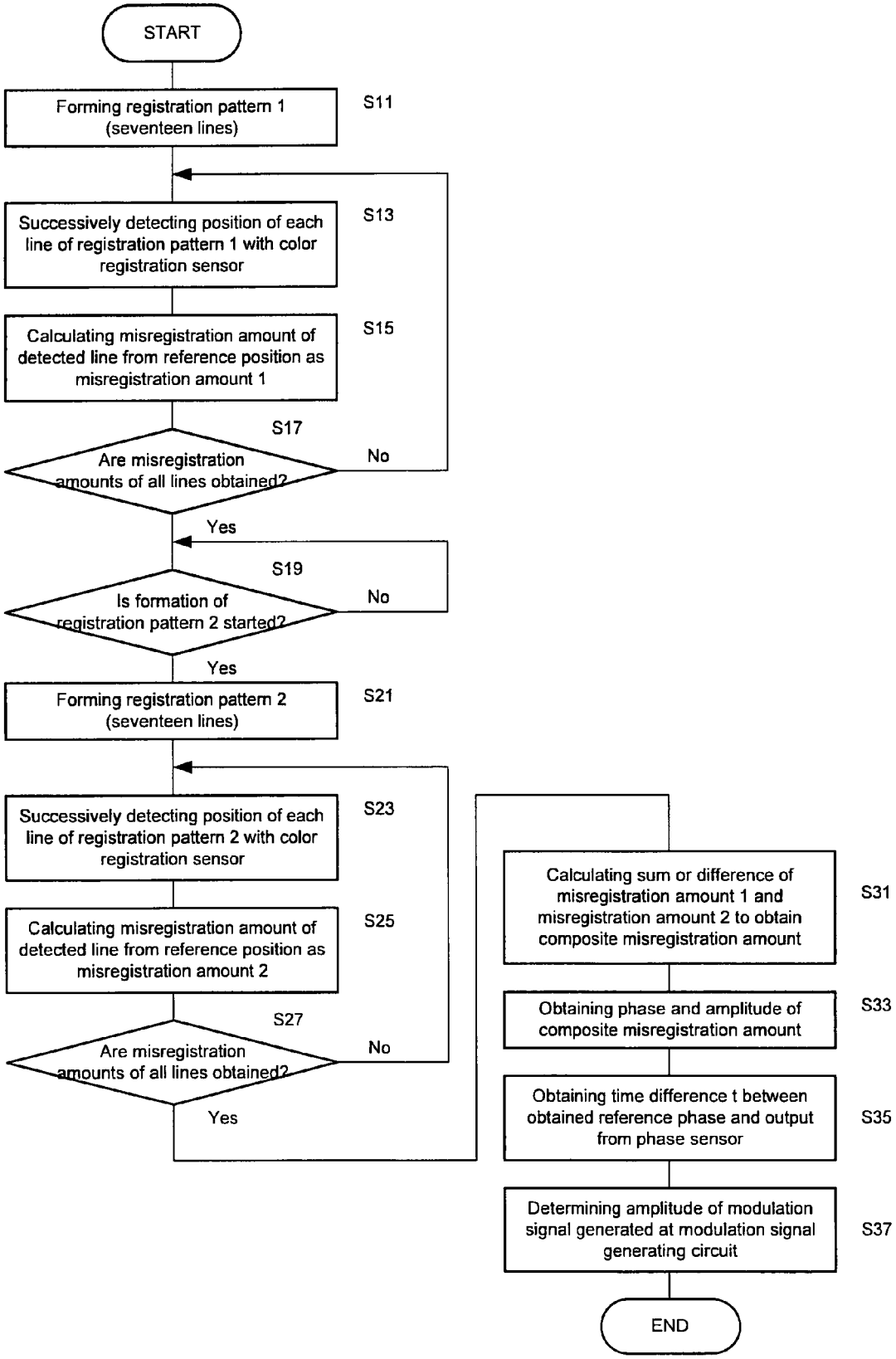
FIG. 21 is a flowchart showing the schematic procedure that a control section 40*a* in FIG. 10 forms and measures the registration toner pattern.

FIG. 21 is a flowchart showing the schematic processing procedure in which the control section 40*a* in FIG. 10 forms the registration toner pattern and measures the same. The flowchart shown in FIG. 21 is for one color, i.e., for one photoconductor. Therefore, the control section 40*a* executes the similar processing to each color of Y, M, C and K. Y is taken as an example in the following explanation.

Figure 20:
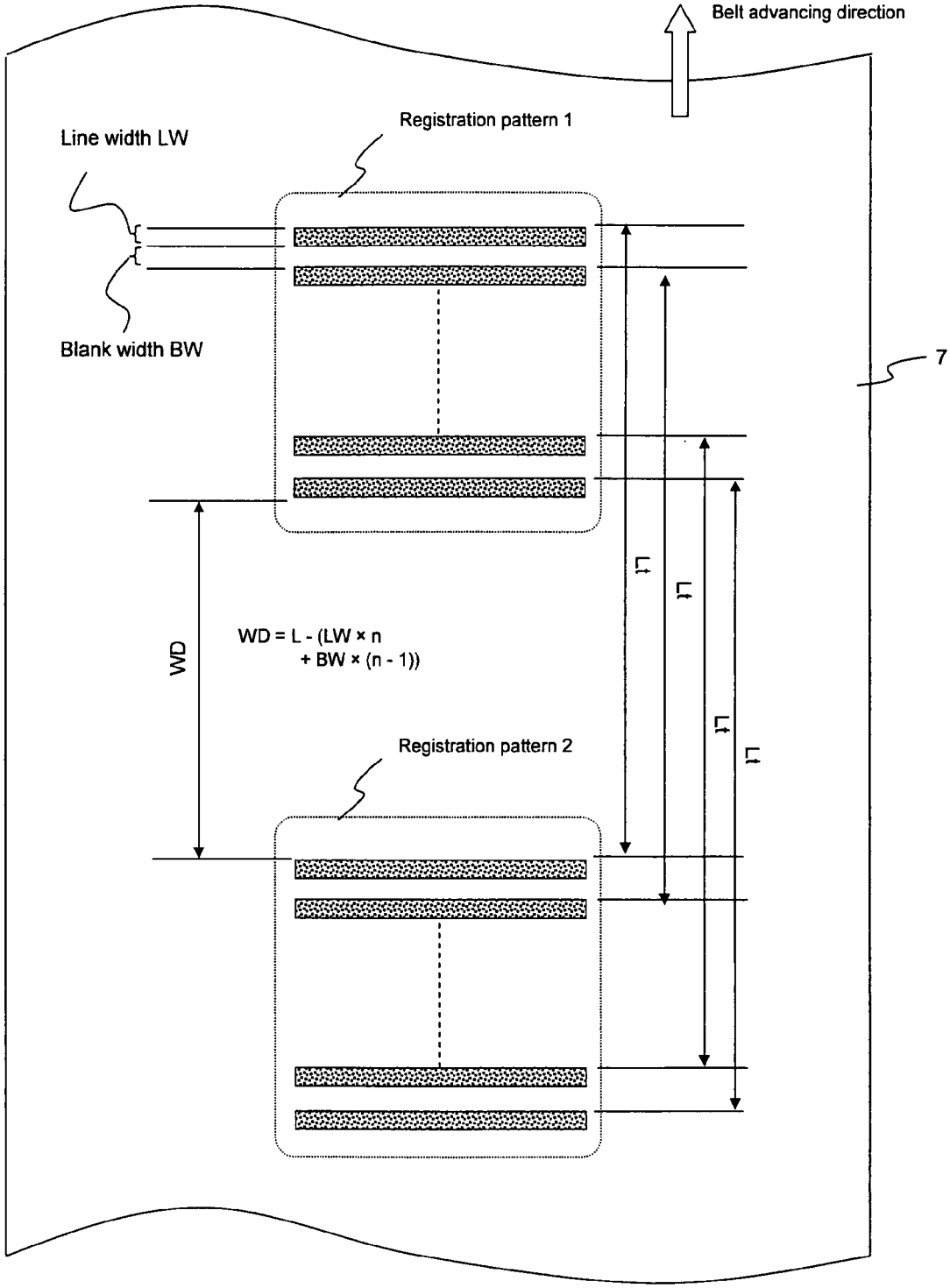
FIG. 20 is an explanatory view showing in detail the registration toner pattern for each color formed in the image forming apparatus according to the present invention.

FIG. 20 is an explanatory view showing the detail of the registration toner pattern in each color formed by the image forming apparatus according to the present invention. As shown in FIG. 20, two patterns, i.e., a registration pattern 1 (hereinafter referred to as pattern 1) and a registration pattern 2 (hereinafter referred to as pattern 2), are formed for each color as the registration toner pattern. These patterns correspond respectively to the registration pattern 1 and the registration pattern 2 shown in FIG. 1. The pattern 1 and the pattern 2 are respectively composed of seventeen lines. Each pattern is as shown in FIGS. 4A to 4C. Ideally, the interval between the top line in the pattern 1 and the top line in the pattern 2 is Lt. The interval between the second line from the top line in the pattern 1 and the second line from the top line in the pattern 2 is also Lt. The interval between the corresponding lines is all Lt hereinbelow. The interval between the last line in the pattern 1 and the top line in the pattern 2 is WD. Therefore, the relationship of $WD=Lt-LW\times n+BW\times(n-1)$ is established between WD and Lt. Here, LW is the width of one line, BW is the shortest distance between the adjacent lines, and n is the number of lines composing each pattern, wherein n=17 in the present embodiment.

The reason for using the term "ideally" is because the aforesaid concept is achieved if there is no eccentricity of the photoconductor drum or other disturbances, but actually, an error is included with respect to the predetermined interval Lt due to these factors.

In FIG. 21, the control section 40*a* first controls each section of the image station relating to the image formation of Y image so as to form the pattern 1 on the Y photoconductor drum 3*d* (step S11). Then, the control section 40*a* transfers the formed pattern 1 onto the intermediate transfer belt 7, and detects the passing timing of each line on the basis of the detection signal from the color registration sensor 42 when each line of the transferred pattern 1 passes the color registration sensor 42 (step S13). Thus, the control section 40*a* calculates the misregistration amount (misregistration amount 1) from the reference timing for each line of the seventeen lines (step S15). The calculated misregistration amount is temporarily stored to be used for the later calculation.

After the measurement for all lines is completed (step S17), the control section 40*a* waits until the timing of starting the formation of the pattern 2 comes (step S19). The timing of forming the pattern 2 is the timing apart from the start of the formation of the pattern 1 by the interval Lt in terms of the distance on the intermediate transfer belt. In the present embodiment, the interval Lt is sufficiently longer than the distance of 680 mm from the intermediate transfer roller 6*d* to the color registration sensor 42. When the interval Lt is shorter than 680 mm or substantially equal to 680 mm, the control section 40*a* forms the pattern 2 before the measurement of the pattern 1 or simultaneously.

The control section 40*a* controls each section of the image station to start the formation of the pattern 2 when the aforesaid timing has come (step S21). Then, the control section 40*a* transfers the formed pattern 2 onto the intermediate transfer belt 7, and detects the passing timing of each line on the basis of the detection signal from the color registration sensor 42 when each line of the transferred pattern 2 passes the color registration sensor 42 (step S23). Thus, the control section 40*a* calculates the misregistration amount (misregistration amount 2) from the reference timing for each line of the seventeen lines (step S25). The calculated misregistration amount is temporarily stored to be used for the later calculation.

After the measurement for all lines is completed (step S27), the control section 40*a* obtains the sum or difference between the misregistration amount 1 and the misregistration amount 2 for each of seventeen lines to obtain the composite misregistration amount d(n) (step S31). Whether the sum is obtained or the difference is obtained is determined according to the setting of the interval Lt. Specifically, when the disturbance component that should be removed has the same phase in the pattern 1 and the pattern 2, the difference is obtained, while when the disturbance component has the reverse phase, the sum is obtained, in order to cancel the disturbance components with each other.

Subsequently, the control section 40*a* executes a process for calculating the reference phase and amplitude of the pitch fluctuation component from the composite misregistration amount d(n) (step S33). An example of obtaining the reference phase and the amplitude is as stated in the explanation of FIG. 4B. Then, the control section 40*a* obtains Δt from the reference phase and the reference signal outputted from the Y phase sensor 43*d* (step S35). Further, the control section 40*a* determines the amplitude of the modulation signal generated by the modulation signal generating circuits 51*a* and 51*b* on the basis of the calculated amplitude (step S37). The phase of the modulation signal is defined as the phase reverse to the phase obtained from the composite misregistration amount for K. Specifically, the phase of the modulation signal is controlled in such a manner that the timing delayed by 180° in terms of the rotational phase angle of the K photoconductor drum 3*a* with respect to the K synchronous signal is employed as the reference phase of the modulation signal generating circuit K51*a*. Further, as for the modulation signal generating circuit (color) 51*b*, the amplitude of the color modulation signal is determined based upon the intermediate value of the maximum amplitude and the minimum amplitude among the amplitudes of each of Y, M and C colors obtained from the composite misregistration amount d(n), and the control section controls the modulation signal generating circuit 51*b* to output the determined signal. The phase of the modulation signal is defined to be the phase reverse to the phase obtained from the composite misregistration amount for Y. Specifically, the phase of the modulation signal is controlled in such a manner that the timing delayed by 180° in terms of the rotational phase angle of the Y photoconductor drum 3*d* with respect to the Y synchronous signal is employed as the reference phase of the modulation signal generating circuit K51*b*.

(Adjustment of Rotational Phase of Photoconductor Drum)

The technique for adjusting the rotational phase of each photoconductor drum will be explained in detail.

As described above, the rotational phase is adjusted by the control for realizing that the eccentric direction of each photoconductor drum 3 after being stopped becomes the predetermined direction, when the control section 40*a* stops each photoconductor drum 3. The control section 40*a* obtains the direction of the eccentricity of each photoconductor drum 3 by measuring the registration toner pattern, and outputs the synchronous signal at the timing when the position of the reference phase corresponding to the obtained eccentric direction is exposed by the laser beam L. As shown in FIG. 16, the output timing of each of Y, M and C synchronous signals matches to one another with the state in which the rotational phase of each Y, M and C photoconductors is adjusted.

Figure 23:
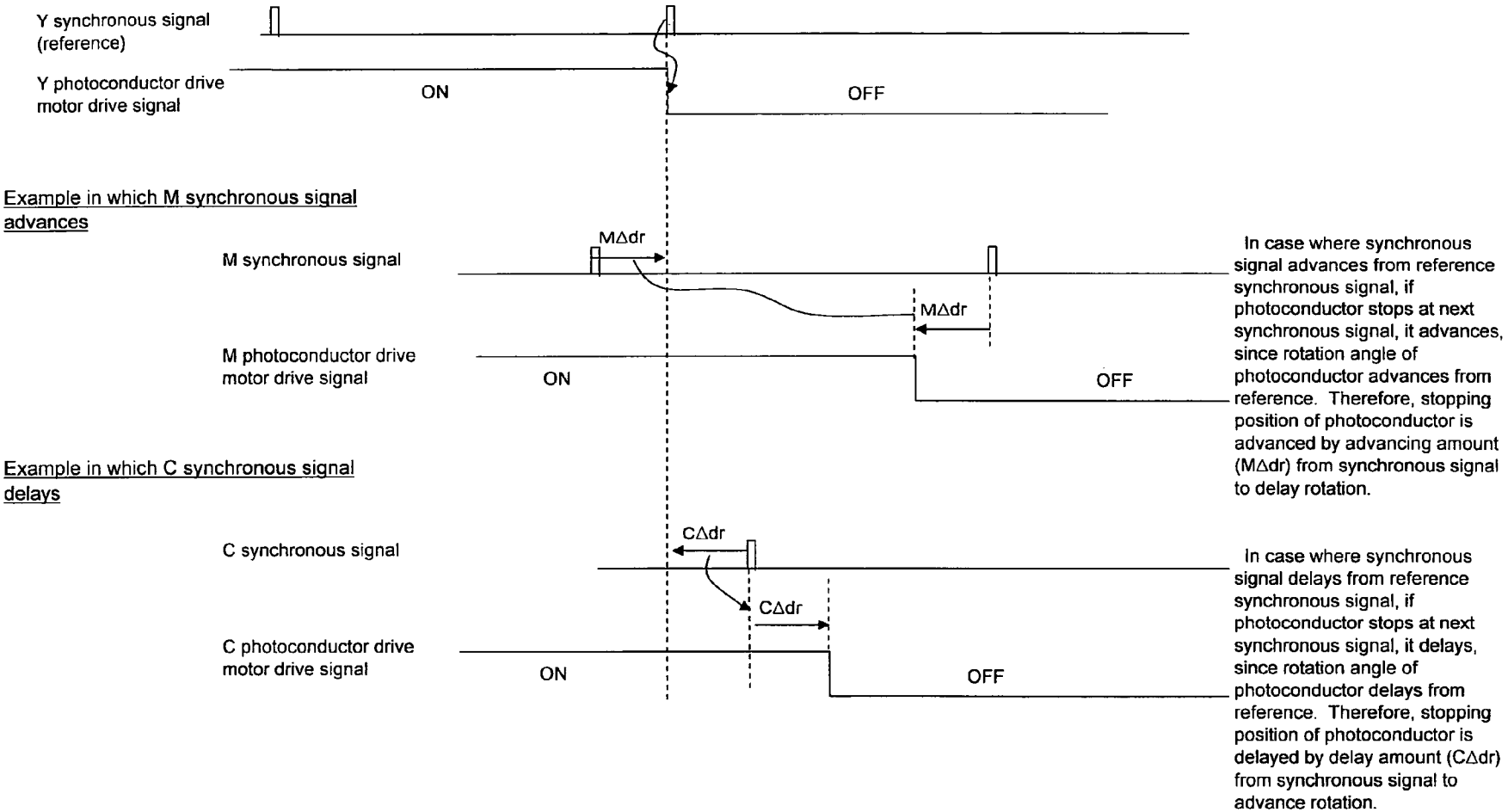
FIG. 23 is an explanatory view showing the state in which the control section 40*a* in FIG. 10 adjusts the stopping positions of an M photoconductor drum 3*c* and a C photoconductor drum 3*b* in such a manner that these photoconductor drums are stopped with each of the rotational phases of these photoconductor drums matched to that of a Y photoconductor drum 3*d*.

FIG. 23 is an explanatory view showing the state in which the stopping positions of the M photoconductor drum 3*c* and the C photoconductor drum 3*b* are adjusted to stop the M photoconductor drum 3*c* and the C photoconductor drum 3*b* with their rotational phases matched with that of the Y photoconductor drum 3*d*. In FIG. 23, the output of the M synchronous signal advances from the Y synchronous signal that is the reference, and the output of the C synchronous signal is delayed from the Y synchronous signal. The control section 40*a* monitors the advance and delay of the M and C synchronous signals with respect to the Y synchronous signal before the stoppage. Specifically, the control section 40*a* obtains the advancing amount MΔdr of the M synchronous signal and the delay amount CΔdr of the C synchronous signal.

Thereafter, the control section 40*a* stops the Y photoconductor drum 3*d*, which is the reference, at the predetermined position. In FIG. 23, the control section 40*a* stops the Y photoconductor drum 3*d* with the Y synchronous signal used as a trigger. The M photoconductor drum 3*c* that advances from the Y synchronous signal, which is the reference for stoppage, is stopped earlier than the M synchronous signal, which is to be outputted afterward, by MΔdr. Thus, the advance of the phase with respect to the Y photoconductor drum 3*d* is corrected. On the other hand, the C photoconductor drum 3*b* is stopped with the delay of CΔdr from the C synchronous signal that is outputted with the delay of CΔdr from the Y synchronous signal, which is the reference for stoppage. Thus, the delay of the phase with respect to the Y photoconductor drum 3*d* is corrected.

When the output of the M synchronous signal is delayed with respect to the Y synchronous signal, the M photoconductor drum 3*c* may be stopped with the delay of the delay amount MΔdr from the M synchronous signal that is outputted with delay from the Y synchronous signal that is the reference for stoppage. FIG. 22 is an explanatory view showing the state in which the control section 40*a* adjusts the rotational phase in case where the M synchronous signal advances or is delayed with respect to the reference signal tref (corresponding to the Y synchronous signal in FIG. 23). The adjustment same as that of the M synchronous signal shown in FIG. 22 may be executed for the C synchronous signal.

It is preferable that the adjustment of the rotational phase is executed every time each photoconductor drum 3 is stopped. There may be a case in which the rotational phase of each photoconductor is gradually deviated unintentionally during the process of continuously printing many pages. This is considered that it is caused by the slight error in the diameter of each photoconductor drum or a disturbance factor of the dive control system. The effect of suppressing the color misregistration can be maintained by matching the rotational phase when the photoconductor drum 3 is stopped.

It is finally apparent that various modifications are possible within the scope of the present invention, in addition to the aforesaid embodiment. The modifications should not be construed not belonging to the feature and scope of the present invention. It is intended that the scope of the present invention includes all modifications within the meaning and scope equivalent to the claims.

What is claimed is:

1. A color registration method to be executed by a computer, in a color image forming apparatus including a plurality of drum-type photoconductors, each photoconductor having a peripheral surface on which images in a predetermined color are formed, the predetermined color being different in each photoconductor, in which some or all of the photoconductors having the same diameter are driven to match pitch fluctuations which are contained in the images formed on the respective photoconductors and which correspond to a rotational cycle of the photoconductors, the method comprising:

a first measurement step for forming a first registration image for each color and measuring formation positions of a plurality of predetermined portions in each registration image;

a second measurement step for forming a second registration image for each color and measuring formation positions of a plurality of predetermined portions in each registration image;

wherein said first and second measurement steps further include forming each of the first and second registration images on the peripheral surface of the same photoconductor so that the first and second registration images are formed at a predetermined interval with respect to corresponding portions of each of the first and second registration images, the predetermined interval being an interval in a rotating direction of the photoconductor;

a calculation step for obtaining deviations of the formation positions of each of the predetermined portions measured in the first and second measurement steps, from a reference position, and for calculating the deviations of each portion for every photoconductor;

wherein the predetermined interval is established so that for disturbance components occurring when the first and second registration images are being formed, in which a cycle is assumed beforehand, such disturbance components are canceled with each other during said calculating the deviations of each portion step;

a step for calculating a periodic fluctuation component corresponding to the rotational cycle of the photoconductor on which the registration images are formed on the basis of the calculated deviation for each registration image, so as to obtain phases thereof;

a step for adjusting a rotational phase of each photoconductor in order for the obtained phases matching to each other;

wherein the color image forming apparatus includes a first photoconductor having a first diameter, a second photoconductor having a second diameter and a drive roller; and wherein the predetermined interval is substantially equal to the integral multiple of the peripheral length of the first photoconductor, to the sum of the integral multiple of the peripheral length of the second photoconductor and its half rotation, and to the sum of the integral multiple of the peripheral length of the drive roller and its half rotation.

2. The registration method according to claim 1, wherein each registration image includes a plurality of straight lines orthogonal to the rotating direction of the photoconductor, and each of the measurement steps measures a formation position of each straight line.

3. The registration method according to claim 1, wherein the image forming apparatus further includes a transferring member for transferring each of the formed images, and a drive roller for superimposing the images in each color by moving the transferring member between the photoconductors, and the disturbance components include periodic disturbances corresponding to the rotational cycle of the drive roller.

4. The registration method according to claim 3, wherein the predetermined interval is an interval between front ends of each of the registration images or between rear ends of each of the registration images; and the calculation step makes a calculation by obtaining the sum of the deviations of each corresponding portion of the registration images.

5. The registration method according to claim 3, wherein:

the calculation step makes a calculation by obtaining the difference between the deviations of each corresponding portion of the registration images.

6. The registration method according to claim 1, wherein:

the registration images are formed on the first photoconductor, and the predetermined interval is set such that periodic disturbances corresponding to the rotational cycle of the second photoconductor cancel with each other.

7. The registration method according to claim 6, wherein:

the calculation step makes a calculation by obtaining the sum of the deviations of each corresponding portion of the registration images.

8. The registration method according to claim 6, wherein:

the calculation step makes a calculation by obtaining the difference between the deviations of each corresponding portion of the registration images.

9. The registration method according to claim 1, wherein the registration images are formed on the first photoconductor, and the predetermined interval is set such that periodic components corresponding to the peripheral length of the second photoconductor cancel with each other, and periodic components corresponding to a peripheral length of the drive roller cancel with each other.

10. The registration method according to claim 9, wherein the calculation step makes a calculation by obtaining the difference between the deviations of each corresponding portion of the registration images.

11. The registration method according to claim 1, wherein the predetermined interval is an interval between front ends of each of the registration images or between rear ends of each of the registration images.

12. A color registration method to be executed by a computer, in a color image forming apparatus including a plurality of drum-type photoconductors, each photoconductor having a peripheral surface on which images in a predetermined color are formed, the predetermined color being different in each photoconductor, in which some or all of the photoconductors having the same diameter are driven to match pitch fluctuations which are contained in the images formed on the respective photoconductors and which correspond to a rotational cycle of the photoconductors, the method comprising:

a first measurement step for forming a first registration image for each color and measuring formation positions of a plurality of predetermined portions in each registration image;

a second measurement step for forming a second registration image for each color and measuring formation positions of a plurality of predetermined portions in each registration image;

wherein said first and second measurement steps further include forming each of the first and second registration images on the peripheral surface of the same photoconductor so that the first and second registration images are formed at a predetermined interval with respect to corresponding portions of each of the first and second registration images, the predetermined interval being an interval in a rotating direction of the photoconductor;

a calculation step for obtaining deviations of the formation positions of each of the predetermined portions measured in the first and second measurement steps, from a reference position, and for calculating the deviations of each portion for every photoconductor;

wherein the predetermined interval is established so that for disturbance components occurring when the first and second registration images are being formed, in which a cycle is assumed beforehand, such disturbance components are canceled with each other during said calculating the deviations of each portion step;

a step for calculating a periodic fluctuation component corresponding to the rotational cycle of the photoconductor on which the registration images are formed on the basis of the calculated deviation for each registration image, so as to obtain phases thereof;

a step for adjusting a rotational phase of each photoconductor in order for the obtained phases matching to each other;

wherein the image forming apparatus includes a first photoconductor having a first diameter, a second photoconductor having a second diameter and a drive roller, wherein the registration images are formed on the first photoconductor, wherein the predetermined interval is set such that periodic components corresponding to the peripheral length of the second photoconductor cancel with each other, and periodic components corresponding to a peripheral length of the drive roller cancel with each other;

wherein the predetermined interval is substantially equal to the integral multiple of the peripheral length of the first photoconductor, to the sum of the integral multiple of the peripheral length of the second photoconductor and its half rotation, and to the sum of the integral multiple of the peripheral length of the drive roller and its half rotation, and the calculation step makes a calculation by obtaining the sum of the deviations of each corresponding portion of the registration images.

13. A color image forming apparatus comprising:

a plurality of drum-type photoconductors in which first and second registration images are respectively formed on a peripheral surface of the same photoconductor;

a measurement section for measuring formation positions of a plurality of predetermined portions in each of the formed registration images;

a deviation calculating section for obtaining deviations of the measured formation positions of each of the predetermined portions from a reference position, and for calculating the deviations of each portion for every photoconductor;

a phase determining section for calculating a periodic fluctuation component corresponding to a rotational cycle of the photoconductor on which the registration images are formed on the basis of the calculated deviation for each registration image, so as to obtain phases thereof;

an adjustment section for adjusting a rotational phase of each photoconductor in order for the obtained phases matching to each other;

an image registration formation section that controls the formation of the first and second registration images on the peripheral surface so that the first and second registration images are formed on the peripheral surface at a predetermined interval with respect to a corresponding portion of each of the first and second registration images;

wherein the predetermined interval is an interval in the rotating direction, which is set such that disturbance components occurring when the first and second registration images are formed, in which a cycle is assumed beforehand, cancel with each other by calculating the deviation;

wherein the color image forming apparatus includes a first photoconductor, a second photoconductor and a drive roller; and wherein the predetermined interval is substantially equal to the integral multiple of the peripheral length of the first photoconductor, to the sum of the integral multiple of the peripheral length of the second photoconductor and its half rotation, and to the sum of the integral multiple of the peripheral length of the drive roller and its half rotation.

14. The image forming apparatus according to claim 13 further comprising a transferring member for transferring each of the formed images, and wherein the drive roller superimposes the images in each color by moving the transferring member between the photoconductors, and wherein the predetermined interval is an interval which is set such that periodic disturbances corresponding to the rotational cycle of the drive roller cancel with each other.

15. The image forming apparatus according to claim 13, wherein:

the first photoconductor has a first diameter and the second photoconductor has a second diameter, the registration images are formed on the first photoconductor, and the predetermined interval is set such that periodic components corresponding to the peripheral length of the second photoconductor cancel with each other, and periodic components corresponding to the peripheral length of a drive roller cancel with each other.

16. An image forming apparatus comprising:

a plurality of drum-type photoconductors in which first and second registration images are respectively formed on a peripheral surface of the same photoconductor;

a plurality of drive sections for rotatably driving each photoconductor at a predetermined drive speed;

a measurement section for measuring formation positions of a plurality of predetermined portions in each of the formed registration images;

a deviation calculating section for obtaining deviations of the measured formation positions of each of the predetermined portions from a reference position, and for calculating the deviations of each portion for every photoconductor;

a phase determining section for calculating a periodic fluctuation component corresponding to a rotational cycle of the photoconductor on the basis of the calculated deviation for each registration image, so as to obtain phases thereof;

an adjustment section for adjusting a rotational phase of each photoconductor in order for phases of speed fluctuation of each photoconductor matching to each other on the basis of the obtained phases;

a correction signal output section for outputting a speed correction signal that is included in each of the formed images for correcting the fluctuation component corresponding to the rotational cycle of each photoconductor;

a drive control section for controlling the drive sections to correct the drive speed of each photoconductor by using the outputted speed correction signal;

an image registration formation section that controls the formation of the first and second registration images on the peripheral surface of the same photoconductor so that the first and second registration images are formed on the peripheral surface at a predetermined interval with respect to a corresponding portion of each of the first and second registration images;

wherein the predetermined interval is an interval in the rotating direction, which is set such that disturbance components occurring when the first and second registration images are formed in which a cycle is assumed beforehand, cancel with each other by calculating the deviation;

wherein the color image forming apparatus includes a first photoconductor, a second photoconductor and a drive roller;

wherein the predetermined interval is substantially equal to the integral multiple of the peripheral length of the first photoconductor, to the sum of the integral multiple of the peripheral length of the second photoconductor and its half rotation, and to the sum of the integral multiple of the peripheral length of the drive roller and its half rotation; and wherein the speed correction signal is a signal having a cycle equal to the rotational cycle of each photoconductor.

17. The image forming apparatus according to claim 16, wherein the first photoconductor has a different diameter from the diameter of the second photoconductor; and the speed correction signal is a signal having a cycle equal to the rotational cycle of each photoconductor according to the diameter.

18. The image forming apparatus according to claim 17, wherein the speed correction signal is common to the photoconductors having the same diameter.

19. An image forming apparatus comprising:

a plurality of drum-type photoconductors in which first and second registration images are respectively formed on a peripheral surface of the same photoconductor;

a plurality of drive sections for rotatably driving each photoconductor at a predetermined drive speed;

a measurement section for measuring formation positions of a plurality of predetermined portions in each of the formed registration images;

a deviation calculating section for obtaining deviations of the measured formation positions of each of the predetermined portions from a reference position, and for calculating the deviations of each portion for every photoconductor;

a phase determining section for calculating a periodic fluctuation component corresponding to a rotational cycle of the photoconductor on the basis of the calculated deviation for each registration image, so as to obtain phases thereof;

an adjustment section for adjusting a rotational phase of each photoconductor in order for phases of speed fluctuation of each photoconductor matching to each other on the basis of the obtained phases;

a correction signal output section for outputting a speed correction signal that is included in each of the formed images for correcting the fluctuation component corresponding to the rotational cycle of each photoconductor;

a drive control section for controlling the drive sections to correct the drive speed of each photoconductor by using the outputted speed correction signal;

wherein the first and second registration images are formed on the peripheral surface of the same photoconductor at a predetermined interval, wherein the predetermined interval is an interval in the rotating direction, which is set such that disturbance components in which a cycle is assumed beforehand, cancel with each other by calculating the deviation;

wherein the color image forming apparatus includes a first photoconductor, a second photoconductor and a drive roller; and wherein the predetermined interval is substantially equal to the integral multiple of the peripheral length of the first photoconductor, to the sum of the integral multiple of the peripheral length of the second photoconductor and its half rotation, and to the sum of the integral multiple of the peripheral length of the drive roller and its half rotation, wherein the speed correction signal is a signal having a cycle equal to the rotational cycle of each photoconductor;

a registration image forming section for forming the registration images composed of a plurality of patterns on each photoconductor;

a fluctuation component calculating section for calculating an amplitude and a phase of a pitch fluctuation component corresponding to the rotational cycle of the photoconductor from a measurement result of each pattern; and a correction signal generating section for generating the speed correction signal having a cycle equal to the rotational cycle on the basis of the calculated amplitude and phase for every diameter.

20. The image forming apparatus according to claim 19 further comprising:

a transferring member for transferring the images formed by each photoconductor, and a rotational phase adjustment section for adjusting the rotational phase of the photoconductor, wherein one of said plurality of drum-type photoconductors is a black image forming photoconductor having a diameter of a first size and others of said plurality of photoconductors are a plurality of color image forming photoconductors each having a diameter of a second size, and each of said plurality of drum-type photoconductors is arranged along the transferring member at a predetermined interval, and the rotational phase adjustment section determines the rotational phase of each of the color image forming photoconductors on the basis of the calculated phase so that the phases of the pitch fluctuation component included in the image formed by the respective color image forming photoconductors and transferred to the transferring member are matched to each other, and adjusts the rotational phase of each of the color image forming photoconductors in such a manner that the respective rotational phases are shifted from the respective determined rotational phases at an angle determined beforehand according to the interval so as to align the rotational phases of the respective color image forming photoconductors.

* * * * *